US005094174A

United States Patent [19]

Grund et al.

[11] Patent Number: 5,094,174

[45] Date of Patent: Mar. 10, 1992

[54] MODULAR FURNITURE

[75] Inventors: Gary H. Grund, Kent City; Craig S. DeDamos, Rockford; Michael L. Deimen, Grand Rapids; Terence M. Duncan, Kalamazoo; David A. Feutz, Grand Rapids; Charles G. Humphrey, Freeport; Royal A. Kent, Grand Rapids; Edmund X. Klipa, Grand Rapids; Thomas R. Maas, Grand Rapids; Jon R. Mullen, West Olive; Randall P. Nelsen; Linda M. Parker, both of Alto; James G. Paulsen, Grand Rapids; Alan L. Pearson, Ionia; Mark T. Slager, Kentwood; Carolyn M. Varellas-Olree, Caledonia; Gale F. Wilcox, Alto; Michael E. Wurth, Grand Rapids, all of Mich.

[73] Assignee: Steelcase Inc., Grand Rapids, Mich.

[21] Appl. No.: 712,958

[22] Filed: Jun. 10, 1991

Related U.S. Application Data

[62] Division of Ser. No. 307,775, Feb. 7, 1989.

[51] Int. Cl.[5] ..... A47B 17/00

[52] U.S. Cl. ..... 108/50; 312/196; 312/223; 108/153

[58] Field of Search ..... 108/50, 90, 153, 149; 312/194, 208, 223

[56] References Cited

U.S. PATENT DOCUMENTS

| | | | |
|---|---|---|---|
| 2,323,107 | 6/1943 | Wilson | 312/196 X |
| 3,027,214 | 3/1962 | Curatolo | 312/196 X |
| 3,770,334 | 11/1973 | Weber | 312/196 X |
| 3,920,299 | 11/1975 | Propst et al. | 312/223 |
| 4,053,701 | 10/1977 | Ogilvie | 312/223 X |
| 4,272,136 | 6/1981 | Sengua | 312/223 X |
| 4,408,543 | 10/1983 | Griffin | 108/50 X |
| 4,734,826 | 3/1988 | Wilson et al. | 312/223 X |
| 4,785,742 | 11/1988 | Esslinger et al. | 108/101 X |
| 4,879,955 | 11/1989 | Moll et al. | 108/50 |

*Primary Examiner*—Peter A. Aschenbrenner
*Attorney, Agent, or Firm*—Price, Heneveld, Cooper, DeWitt & Litton

[57] ABSTRACT

A freestanding modular furniture arrangement is provided to create workstations in open office plans, and other similar applications. Each furniture unit includes a worksurface with capped cutouts in the rear corners to mount overhead cabinets, privacy screens, and other furniture accessories. A mounting rail extends continuously along the rearward edge of each worksurface, and is capable of removably supporting therein a plurality of different amenities, such as bookshelves, CRT stands, fans, task lamps, etc., so as to permit a worker to personalize his or her own workstation. A removable stanchion permits certain convertible amenities to be supported either freestanding on the worksurface, or along the rear of the worksurface on the mounting rail. An L-shaped intermediate leg is available to support the worksurface in a cantilevered fashion to facilitate unfettered task chair movement along the forward edge of the worksurface.

27 Claims, 22 Drawing Sheets

MODULAR FURNITURE

This is a divisional of co-pending application Ser. No. 07/307,775, filed on Feb. 7, 1989.

CROSS-REFERENCES TO RELATED APPLICATIONS

The present application is related to co-pending U.S. patent applications Ser. No. 307619, filed Feb. 7, 1989, entitled FLOOR TRACK SYSTEM FOR OFFICE FURNITURE AND THE LIKE; Ser. No. 307691, filed Feb. 7, 1989, entitled VERTICAL STORAGE UNIT FOR MODULAR FURNITURE; and Ser. No. 307689, filed Feb. 7, 1989, entitled MONOLITHIC FINISHING PROCESS AND MACHINE FOR FURNITURE PARTS AND THE LIKE, which are hereby incorporated by reference.

BACKGROUND OF THE INVENTION

The present invention relates to furnishings for offices and the like, and in particular to freestanding modular furniture arrangements for open office plans, and other similar applications.

Open office plans are well known in the art, and generally comprise large, open floor spaces that are partitioned off into individual workstations by movable panels. Such partition panels often include an electrical raceway along the bottom of the panel to provide electrical power to the various workstations. Two examples of such open office plans are disclosed in the Propst et al. U.S. Pat. No. 4,235,495 and the Driscoll U.S. Pat. No. 4,135,755.

Partition panels in such open office plans are typically configured to receive hang-on furniture units, such as worksurfaces, overhead cabinets, shelves, etc., so that the panels become an integral part of the workstation furnishings. One example of such a partition panel arrangement is disclosed in the Breiner U.S. Pat. No. 3,916,972.

The above-noted partition panels and hang-on furniture arrangements are usually known in the office furniture industry as "systems furniture." Such systems furniture arrangements have some inherent restrictions in versatility, since each workstation must necessarily include certain types of partition panels in order to support the hang-on furniture units. Furthermore, the hang-on furniture units can generally be assembled only in a rather limited number of different arrangements.

The present invention provides a unique alternative arrangement for dividing and partitioning off open office plans by providing a plurality of individual, freestanding furniture units, each of which is independently supported on the floor of the open office. The furniture units have a novel modular construction which permits them to be individually arranged and combined in numerous configurations to create a selected number of distinct workstations, without requiring a separate partition panel system. Hence, the modular furniture arrangement is extremely versatile and capable of providing privacy areas for the worker, yet is not tied to a specific partition panel system. A unique accessory mounting arrangement permits each worker to personalize his or her own workstation in a manner that locates the accessories at a convenient position, without cluttering the top of the worksurface. An L-shaped intermediate leg is available to support the worksurface in a cantilevered fashion to facilitate unfettered task chair movement along the forward edge of the worksurface.

SUMMARY OF THE INVENTION

One aspect of the present invention is a modular furniture unit having a transaction post arrangement. The modular furniture unit comprises at least one worksurface panel, and at least two supports connected with the worksurface panel to form a freestanding furniture unit. The modular furniture arrangement includes at least one overhead unit, and at least two rigid transaction posts, which have their lower ends shaped for connection with the supports, and their upper ends shaped for connection with the overhead unit. At least two mounting apertures are disposed through the worksurface panel adjacent the opposite rear corners thereof. Each of the mounting apertures is shaped to receive an associated one of the transaction posts therethrough Caps are detachably supported on the worksurface panel, and selectively close at least selected portions of the mounting apertures. To mount the overhead unit on the furniture unit, the caps are removed from the worksurface panel, and the opposite ends of the transaction posts are connected with the supports and the overhead unit respectively.

Another aspect of the present invention is a modular furniture arrangement having an amenity mounting rail system. The modular furniture unit comprises at least one worksurface panel, having supports connected at opposite ends thereof to form a modular, freestanding furniture unit. A plurality of different amenity units are provided, each of which has a lower end adapted for mounting the same on the furniture unit, and an upper end adapted to equip the furniture unit. A mounting rail is connected with and supported by the furniture unit, and extends generally continuously along the rearward edge of the worksurface panel. The mounting rail includes a plurality of substantially identical apertures spaced generally regularly along the length of the mounting rail. The apertures are shaped to closely receive therein the lower ends of any one of the amenity units to securely yet removably mount the same therein, whereby one or more of the amenity units can be arranged and detachably mounted in the mounting rail substantially anywhere along the rearward edge of the worksurface panel to personalize the modular furniture unit.

Yet another aspect of the present invention is an amenity unit for freestanding modular furniture and the like of the type having a worksurface with an apertured mounting rail extending generally continuously along the rearward edge thereof. The amenity unit includes an arrangement for equipping the furniture unit, as well as at least two rigid prongs which project generally downwardly from the lower portion of the amenity unit, and are shaped to be closely received within the associated apertures of the mounting rail to support the same therein. The amenity unit can be arranged and detachably mounted in the mounting rail substantially anywhere along the rearward edge of the worksurface to personalize the modular furniture unit.

Yet another aspect of the present invention is a modular furniture unit having a stanchion assembly. The modular furniture unit comprises a worksurface panel supported at a predetermined elevation. A plurality of convertible amenity units are provided, each of which is shaped to equip the furniture unit, and includes a base, which is configured to abuttingly support the amenity unit on the upper surface of the worksurface panel in a freestanding fashion, and includes a first detachable connector. A mounting rail is connected with and supported by the furniture unit, and extends along a selected portion of the worksurface panel. The mounting rail includes a plurality of second detachable connectors spaced generally along the length of the mounting rail. A stanchion is provided, having a lower portion with a third detachable connector configured to mate with the second detachable connector on the mounting rail, and an upper portion with a fourth detachable connector configured to mate with the second detachable connector on the convertible amenity unit to support the same in an elevated position above the upper surface of the worksurface panel. The convertible amenity units can be supported either freestanding on the worksurface, or attached to the stanchion and mounted in the mounting rail above the worksurface to permit personalization of the furniture unit.

Yet another aspect of the present invention is a modular furniture unit having a grommet and cap screen mounting system. The modular furniture arrangement comprises at least one worksurface panel with supports connected with opposite ends thereof. At least one privacy screen is provided with fasteners adjacent opposite sides thereof for mounting the privacy screen on the furniture unit. First and second mounting apertures are disposed through the worksurface panel adjacent the rearward corners of the worksurface panel. Second connectors are positioned underlying the two mounting apertures, and releasably engage the fasteners on the privacy screen to mount the same in a generally vertical orientation adjacent the rearward edge of the worksurface panel. At least two caps are provided to close the associating apertures, and are detachably supported on the worksurface panel, whereby to mount the privacy screen on the furniture unit, the caps are removed from the worksurface panel, the first and second fasteners are detachably interconnected, and the caps are reattached to the worksurface panel.

Yet another aspect of the present invention is a modular furniture unit having a cantilevered intermediate support. The modular furniture unit comprises at least one worksurface panel, having an end support connected adjacent one end of the worksurface panel. At least one intermediate support is attached to the opposite end of the worksurface panel, and includes an inverted, generally L-shaped side elevational configuration. The upper arm of the intermediate support is attached to the worksurface panel, such that the intermediate support supports the worksurface panel on the floor in a cantilevered fashion, with the space disposed underneath the worksurface panel adjacent to the intermediate support being generally open and unobstructed to facilitate unfettered task chair movement along the forward edge of the worksurface panel.

The principle objects of the present invention are to provide a unique arrangement for dividing and partitioning off open office plans, without requiring a conventional partition panel system. A plurality of freestanding, modular furniture units are independently supported on the floor of the office space, and can be arranged in a multitude of different configurations to create distinct workstations. A unique worksurface and transaction post system permits easy mounting of overhead cabinets, countertops, privacy screens, and other similar furniture accessories. Furthermore, a mounting rail extends along each rearward edge of the worksurface to removably support a plurality of different amenity units to fully equip the workstation. A stanchion system enables at least some of the amenities to be supported either freestanding on the worksurface, or elevated above the worksurface on the mounting rail. These features combine to permit the worker to personalize their own workstation in a manner that best accommodates their particular needs and tasks, without requiring any permanent or specialized fixtures. The worksurfaces may be supported in a cantilevered fashion by intermediate supports to facilitate unfettered task chair movement along the forward edge of the worksurface. The furniture arrangement is efficient in use, economical to manufacture, capable of a long operating life, and particularly well adapted for the proposed use.

These and other advantages of the invention will be further understood and appreciated by those skilled in the art by reference to the following written specification, claims and appended drawings.

BRIEF DESCRIPTION OF THE DRAWINGS

FIG. 17A is a perspective view of the post cap shown attached to the grommet, with the grommet cap in place.

FIG. 47A is a perspective view of the diagonal paper manager amenity unit shown in FIG. 47, with the stanchion removed.

FIG. 47B is a perspective view of a carrier portion of the diagonal paper manager amenity unit.

DETAILED DESCRIPTION OF THE PREFERRED EMBODIMENTS

Figure 3:
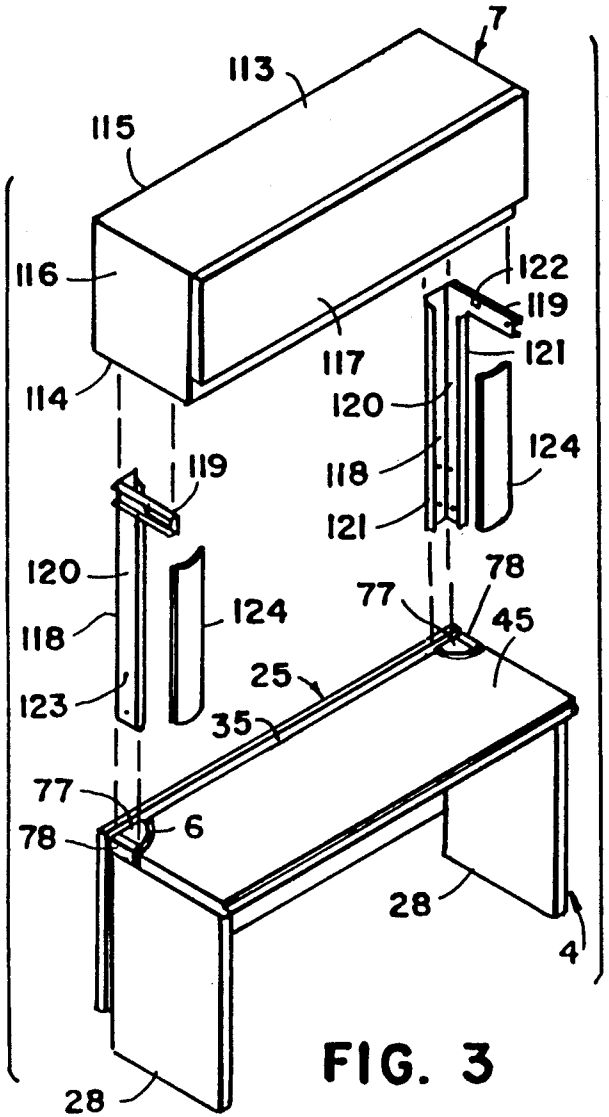
FIG. 3 is an exploded perspective view of a straight modular furniture unit, an overhead cabinet, and an interconnecting transaction post arrangement.

For purposes of description herein, the terms "upper," "lower," "right," "left," "rear," "front," "vertical," "horizontal," and derivatives thereof shall relate to the invention as oriented in FIG. 3, and with respect to a seated user. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein, are not to be considered as limiting, unless the claims expressly state otherwise.

The reference numeral 1 (FIG. 1) generally designates a modular furniture arrangement embodying the present invention. Modular furniture arrangement 1 is particularly well adapted for use in conjunction with open office plans, such as the illustrated office space 2 with open floor surface 3. Modular furniture arrangement 1 comprises a plurality of individual furniture units which are generally designated by the reference numeral 4. Each furniture unit 4 includes a worksurface 5 with capped cutouts 6 in selected corners to mount overhead cabinets 7, privacy screens 8, and other similar furniture accessories. Differently styled furniture units 4, as well overhead cabinets 7, and privacy screens 8 are arranged in a selected fashion, so as to create individual workstations 11 that are tailored to the needs of the particular worker, and the task involved. A mounting rail 12 (FIG. 34) extends generally continuously along the rearward edge of each worksurface 5, and serves to removably support a plurality of different amenity units thereon, which are noted generally by the reference numeral 13. The amenity units 13 are preferably selected individually by the worker to equip their workstation according to his or her particular needs and desires. An L-shaped intermediate leg 14 (FIG. 2) is available to support worksurface 5 in a cantilevered fashion to facilitate unfettered task chair movement along the forward edge of worksurface 5.

Figure 1:
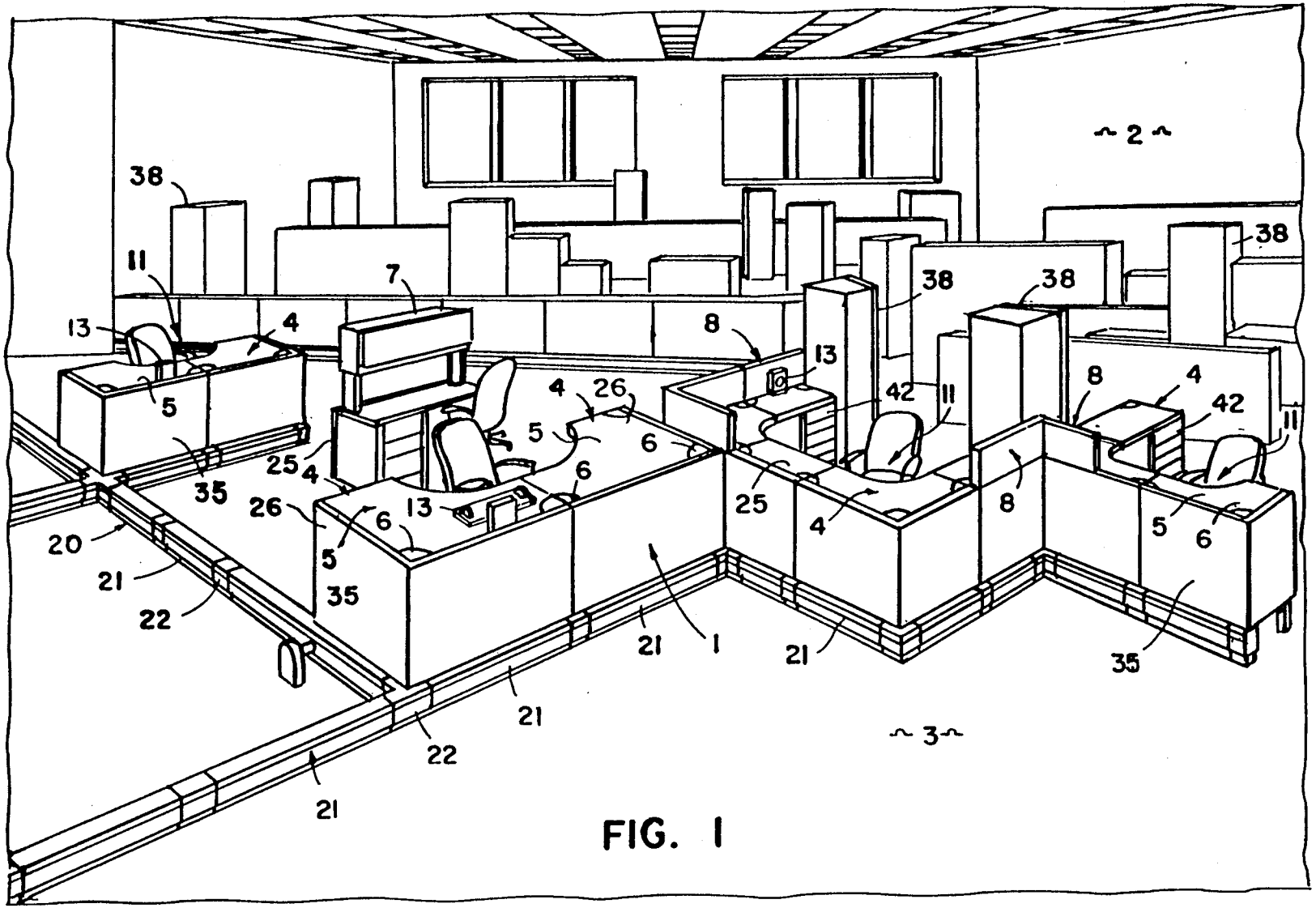
FIG. 1 is a perspective view of a modular furniture arrangement embodying the present invention, shown in combination with a floor track utility system.
Figure 2:
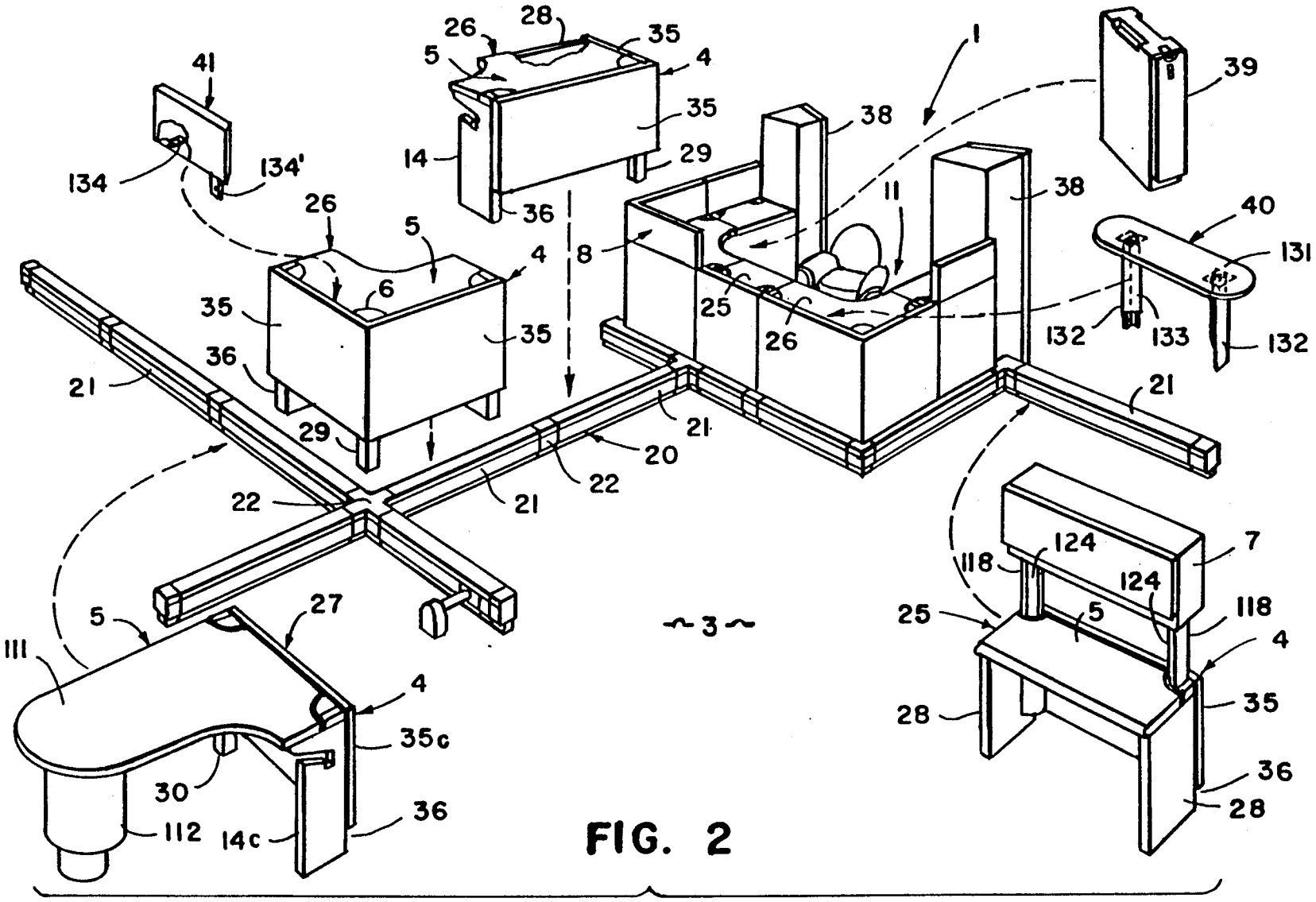
FIG. 2 is an exploded perspective view of the modular furniture arrangement, and floor track utility system.
Figure 6:
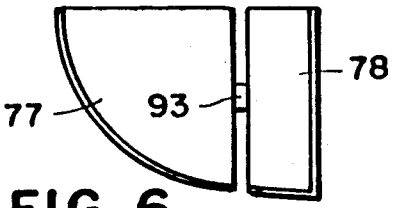
FIG. 6 is a top plan view of the post and grommet caps.

With reference to FIGS. 1 and 2, the illustrated modular furniture arrangement 1 is particularly adapted for use in conjunction with a unique utility floor track network or system 20, which is the subject of co-pending patent application Ser. No. 307682, filed Feb. 7, 1989, entitled FLOOR TRACK SYSTEM FOR OFFICE FURNITURE AND THE LIKE, and has been incorporated herein by reference. Floor track system 20 is designed to route utilities to workstations 11 in office space 2, and includes a plurality of individual floor track segments 21, each of which has a hollow interior in which the utilities are housed and isolated. Each floor track segment 21 has feet (not shown) adjacent opposite ends, which independently support the track segment on the floor 3 of office space 2 in a generally upright orientation. Each floor track segment 21 also has an exterior shape which mates with each of the modular furniture units 4 in each workstation 11, without supporting the same. Opposite ends of floor track segments 21 are detachably interconnected in a predetermined configuration, preferably by differently shaped connectors 22, so as to form a continuous, self-contained and self-supported utility raceway that is physically separate from the modular furniture units 4, yet dimensionally cooperates and blends in with them. Floor track system 20 permits locating utility taps, such as electrical receptacles (not shown), throughout the system, so as to provide utilities to each of the workstations 11 as required.

In the illustrated modular furniture arrangement 1, three different styles of furniture or core units 4 are illustrated, including straight surface or core units 25 (FIG. 2), corner surface or core units 26, and bullet conference units 27. However, it is to be understood that the present invention contemplates other styles of furniture units 4, as will be readily appreciated by those skilled in the art.

Each of the illustrated furniture units 25–27 includes a worksurface 5 selected from a wide variety of different shapes and sizes, with two separate supports located at opposite ends of worksurface 5, in the form of either an end panel 28, or an intermediate support 14. For example, the corner unit 26 illustrated in the upper portion of FIG. 2 has an intermediate support 14 at one end of worksurface 5, and an end panel 28 at the opposite end of worksurface 5. In contrast, the straight unit 25 illustrated in FIG. 2 has two end panels 28 at the opposite ends of worksurface 5. A corner leg 29 is provided at the center of the corner units 26. A conference leg 30, having a construction somewhat similar, to intermediate support 14, except less deep, is provided at one end of the bullet conference units 27.

Each of the illustrated modular furniture units 25–27 (FIG. 2) also includes at least one back panel 35, which covers the rear faces or surfaces of the associated furniture unit. For example, the straight unit 25 illustrated in FIG. 2 has a single back panel 35 which extends between the two end panels 28 along the rear of the furniture unit. The corner units 26 have two back panels 35, which extend between the corner leg 29 and the associated end supports. Back panels 35 have a specially designed, predetermined depth, so as to form a gap or recess 36, which extends along the forward base area of each of the furniture units 4, and is adapted to receive therein floor track system 20. The arrangement illustrated in FIG. 2 clearly shows the recess 36 in the furniture units 25–27, and its physical cooperation with the floor track system 20.

In the open office plan arrangement illustrated in FIGS. 1 and 2, additional modular furniture units and related accessories are provided, including storage towers 38, day filers 39, countertop units 40, corner screen units 41, and freestanding pedestals 42. Many characteristics of these additional furniture units and accessories are unique, independent of modular furniture arrangement 1, and are the subject of co-pending patent applications.

Figure 18:
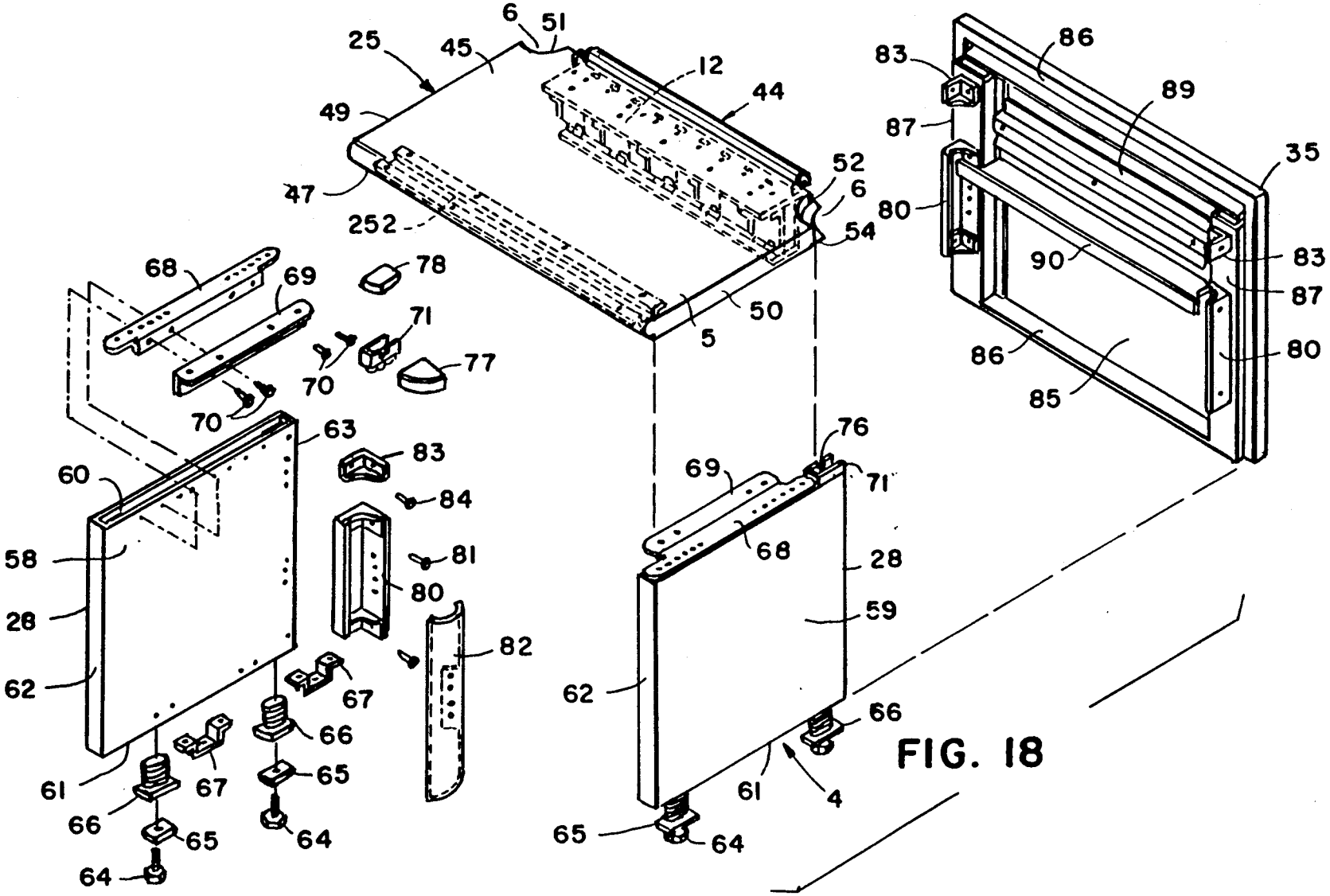
FIG. 18 is an exploded perspective view of the straight modular furniture unit, shown with two end panels.

With reference to FIG. 18, the illustrated straight surface unit 25 has four basic components, comprising a straight worksurface assembly 44, a pair of end panels 28, and a back panel 35. Preferably, worksurface assembly 44 is provided in a number, of different lengths, and at least two different widths to accommodate a wide variety of applications. End panels 28, intermediate legs 14, and back panels 35 are similarly provided in different sizes to mate with the various worksurface assemblies 44. End panels 28 are connected with worksurface 45 opposite ends thereof in the manner described in greater detail hereinafter. Back panel 35 is attached to both straight worksurface 45, and end panels 28, so as to form a complete straight unit 25.

Figure 22:
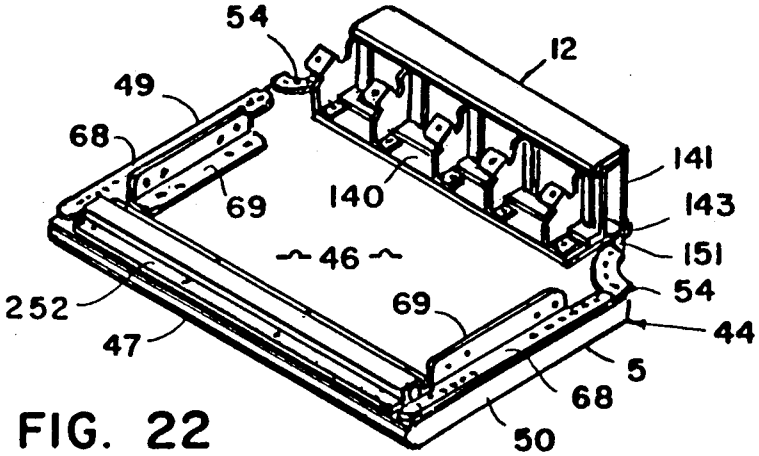
FIG. 22 is a bottom perspective view of the worksurface panel assembly.
Figure 20:
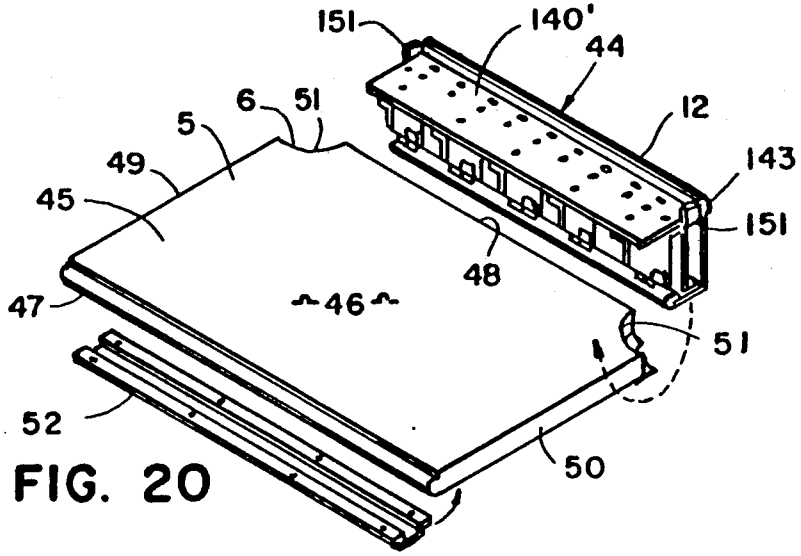
FIG. 20 is an exploded top perspective view of a worksurface panel assembly.
Figure 21:
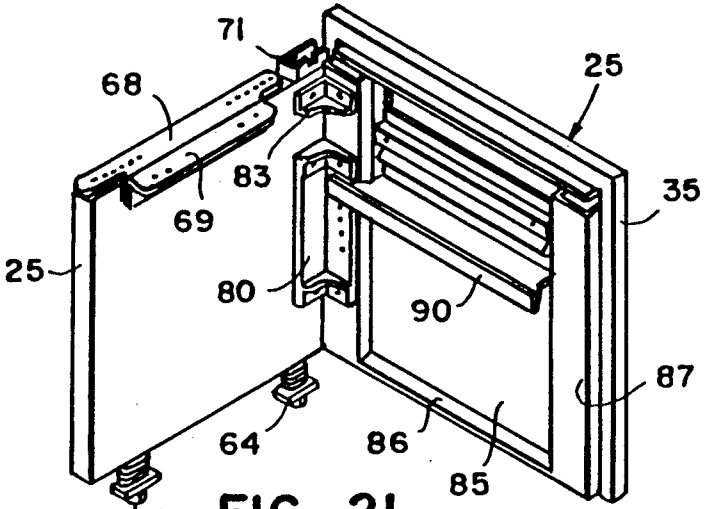
FIG. 21 is a perspective view of a partially assembled straight modular furniture unit.
Figure 24:
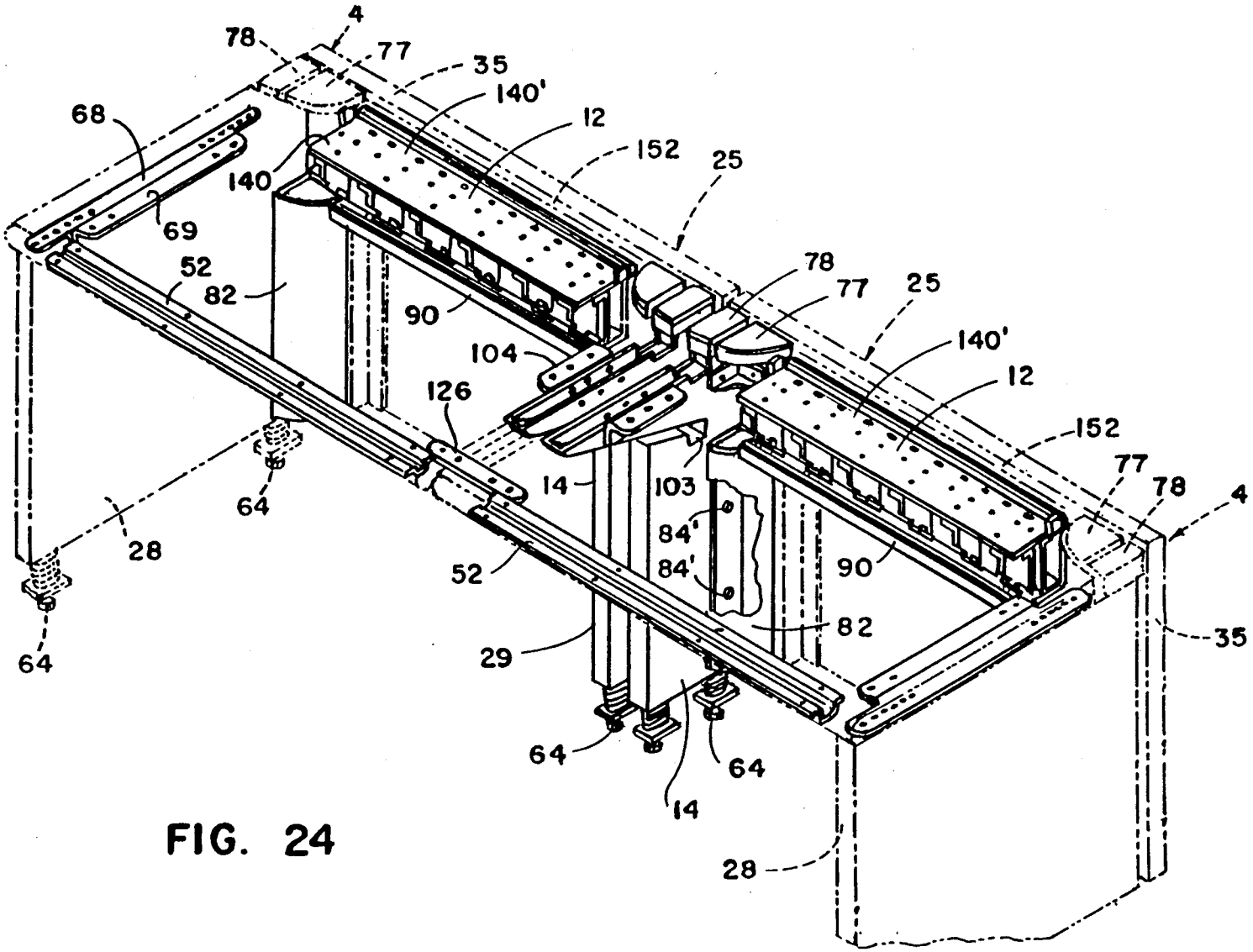
FIG. 24 is a perspective view of two adjacent straight modular furniture units, wherein the worksurfaces and end panels are shown in phantom to better illustrate internal construction.
Figure 26:
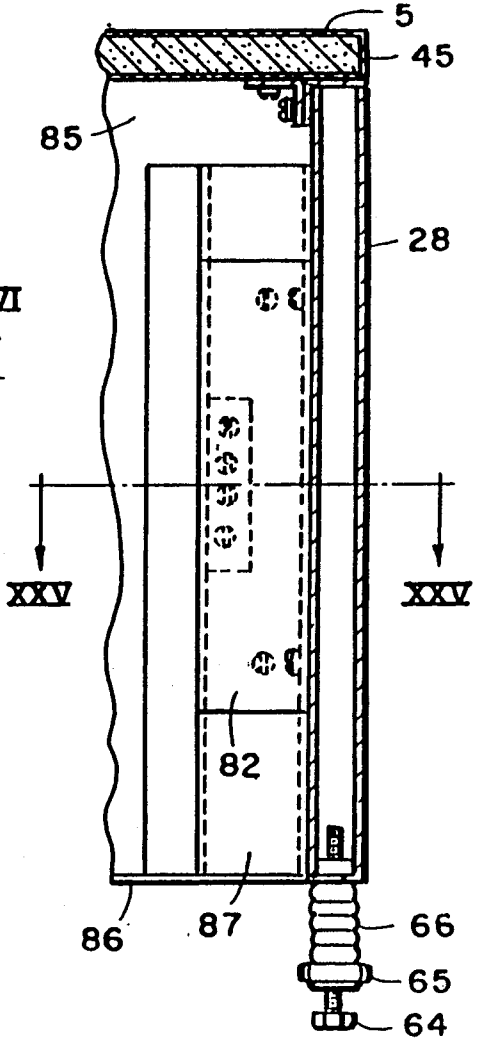
FIG. 26 is a fragmentary, vertical cross-sectional view of the straight modular furniture unit, taken along the line XXVI—XXVI, FIG. 25.

The straight worksurface assembly 44 includes a worksurface panel 45 (FIGS. 20 and 22) having a generally rectangular top plan configuration, and including flat, parallel top and bottom surfaces 46, a front edge 47, a rear edge 48, and opposite side edges 49 and 50. Straight worksurface panel 45 may be constructed from a sheet of rigid material, such as fiberboard or the like, and is preferably provided with an exterior coating, such as a high strength laminate, wood veneer, or other similar treatment to form a suitable surface on which writing and other tasks may be performed. A unique process for manufacturing worksurfaces such as straight worksurface panel 45, is the subject of co-pending patent application Ser. No. 307689, filed Feb. 7, 1989, entitled MONOLITHIC FINISHING PROCESS AND MACHINE FOR FURNITURE PARTS AND THE LIKE, which has been incorporated herein by reference. Arcuately shaped cutouts 6 are provided in the rear corners of worksurface 45, and interconnect the adjacent rear and side edges 48–50 respectively. In the illustrated example, cutouts 6 have a quarter-circle plan shape defined by arcuate marginal edges 51 and 52 respectively. Edges 48–52 of worksurface 45 are flat, disposed generally perpendicular to the upper and lower surfaces 46 of worksurface 45, whereas front edge 47 is rounded in the shape of a bullnose to provide a protective ornamental edge configuration to worksurface 45. A reinforcing brace 52 may be provided for longer worksurface assemblies 44, and is fastened to the lower surface 46 of worksurface 45 adjacent front edge 47 to rigidify worksurface 45. An amenity rail 12 is attached to the lower surface 46 of worksurface 45, and extends along the length of rear edge 48 to attach amenity units 13 to the straight furniture unit 25 in the manner described in greater detail hereinafter. A pair of arcuately shaped flaps or covers 54 are attached to the lower surface 46 of worksurface panel 45 at cutouts 6, and protrude radially outwardly of curved marginal edges 51 and 52.

The illustrated end panel 28 (FIGS. 18, 19 and 25) has a generally rectangular shape with a hollow, formed sheet metal construction, comprising inner and outer face panels 58 and 59, and marginal edges 60–63. A pair of adjustable glides 64 are mounted in the recess formed along the bottom edge 61 of end panel 28 by a glide plate 65, and a glide shield 66. Axial rotation of glide 64 with respect to end panel 28 raises and lowers the associated end panel 28. A pair of U-shaped brackets 67 are temporarily mounted in the bottom edge 61 of end panel 28, and are adapted to receive cross braces (not shown) to facilitate shipping. An L-shaped inner end panel mounting bracket 68 is received within the recess formed along the top edge 60 of end panel 28, and serves to close the same. An L-shaped outer end panel mounting bracket 69 is positioned adjacent inner end panel bracket 68 on the interior face 58 of end panel 28. Fasteners 70 extend through both inner and outer mounting brackets 68 and 69, as well as the interior face 58 of end panel 28 to securely interconnect the same. Inner and outer mounting brackets 68 and 69 serve to attach end panel 28 to the lower surface 46 of worksurface panel 45, as described below. End panels 28 have a modular construction, with the top edge 60 and bottom edge 61 being substantially identical in shape, such that feet 64, and brackets 68–69 can be mounted in either end. The modular construction of end panel 28 provides a non-handed arrangement, such that end panel 28 can be attached to either end of a worksurface panel 45 by simply reversing the vertical orientation of end panel 28, as well as the position of connector brackets 68–69, feet members 64–66, and a grommet 71, which is described in detail below.

With reference to FIGS. 13–17A, grommet 71 is positioned in a socket 56 formed between rear portions of the faces 58 and 59 of each end panel 28, and is retained in socket 56 by a fastener 72. Each end panel 28 includes four sockets 56 positioned at the opposite corners of top and bottom edges 60 and 61. Each socket 56 has three threaded apertures 57 which serve to mount a grommet 71 in the top rear socket 56 in the manner described below. The sockets 56 on the bottom edge of end panel 28 receive and retain feet members 64–66 therein, with the threaded post of foot 64 engaged in the center threaded socket aperture 57. In general, grommets 71 support post caps 77, and facilitate mounting a privacy screen 8 to a selected furniture unit 4 in the manner described in greater detail below. Each grommet 71 has a cupped configuration, with an inclined central mounting surface 73 recessed below the upper marginal edge of grommet 71. Grommet mounting surface 73 has a center apertured socket 74 in which fastener 72 is received in a countersunk fashion and two other fastener apertures 75 and 75' on opposite sides thereof The forwardmost fastener aperture 75' has a socket like construction similar to socket 74 for purposes to be described below. The bottom of grommet 71 has an in-turned marginal edge construction for close telescoping reception in the mating socket 56 formed between the opposite faces 58 and 59 of end panel 28. The rearward end of the grommet sidewall is open, and a notch 76 is disposed in the inner sidewall to facilitate detachably mounting post caps 77 in the manner set forth below. Grommet 71 is retained in socket 56, and attached to end panel 28 by a center fastener 72, which extends through center grommet aperture 74 and threadedly engages the center threaded aperture 57 of end panel 28, and two end fasteners 138 which extend through a mounting bracket on privacy screen 8, and end grommet apertures 75 and 75', and threadedly engage the end threaded apertures 57 of end panel 28, as more fully described below.

Figure 13:
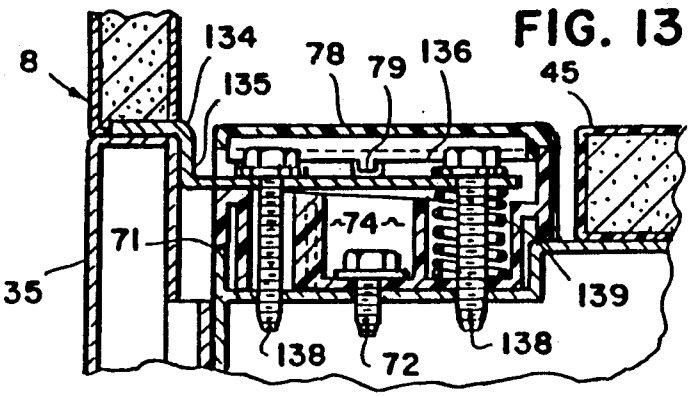
FIG. 13 is a fragmentary vertical cross-sectional view of the straight modular furniture unit, particularly showing attachment of the privacy screen assembly
Figure 17:
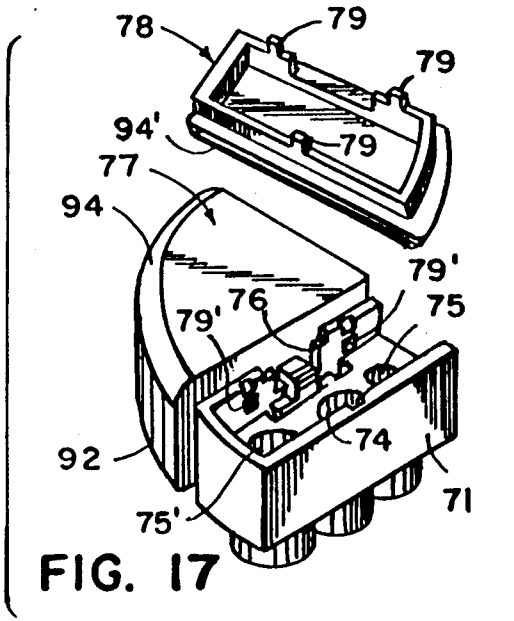
FIG. 17 is a perspective view of the post cap shown attached to the grommet, with the grommet cap exploded away.

A grommet cap 78 is provided to cover the open top of each grommet 71. Each grommet cap 78 has a substantially rectangular plan elevational shape with an arcuate rear edge, and mates with the upper marginal edge of an associated grommet 71, and a depending lip with three snap-lock arms 79 that engage three mating apertures 79' in grommet 71. As best illustrated in FIG. 13, grommet cap 78 cover the outside margin of grommet 71, as well as the rear open end thereof.

Straight surface unit 25 also includes an L-shaped brace 80 (FIG. 18) having one leg thereof attached to the inner face 58 of end panel 28, along its rear edge 63 by fasteners 81. An arcuately shaped cover 82 is removably attached to brace 80, and covers the open face thereof to form a raceway for wires and other utilities. An L-shaped gusset 83 also has one leg thereof attached to the inner face 58 of end panel 28 by fasteners 84 at a location adjacent the uppermost portion of rear edge 63, above brace 80. Brace 80 and gusset 83 have their opposite legs attached to the interior face of an associated back panel 35 to rigidly interconnect straight unit 25. When assembled, the rear edge 63 of end panel 28 is disposed substantially flush with the rear edge 48 of worksurface panel 45.

Figure 23:
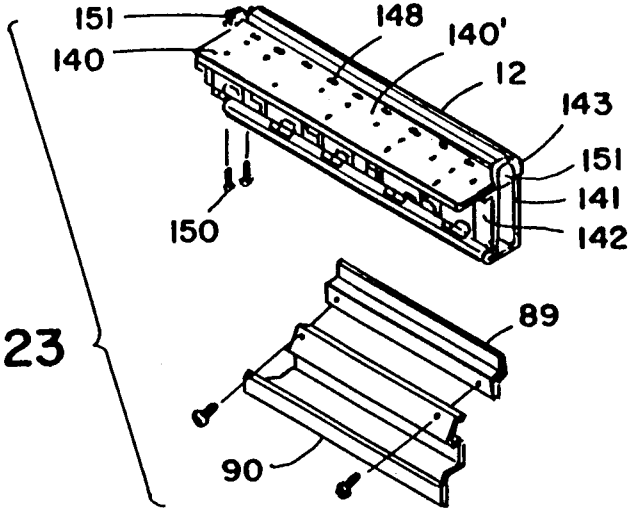
FIG. 23 is an exploded perspective view of an amenity mounting rail and a cable support channel.
Figure 25:
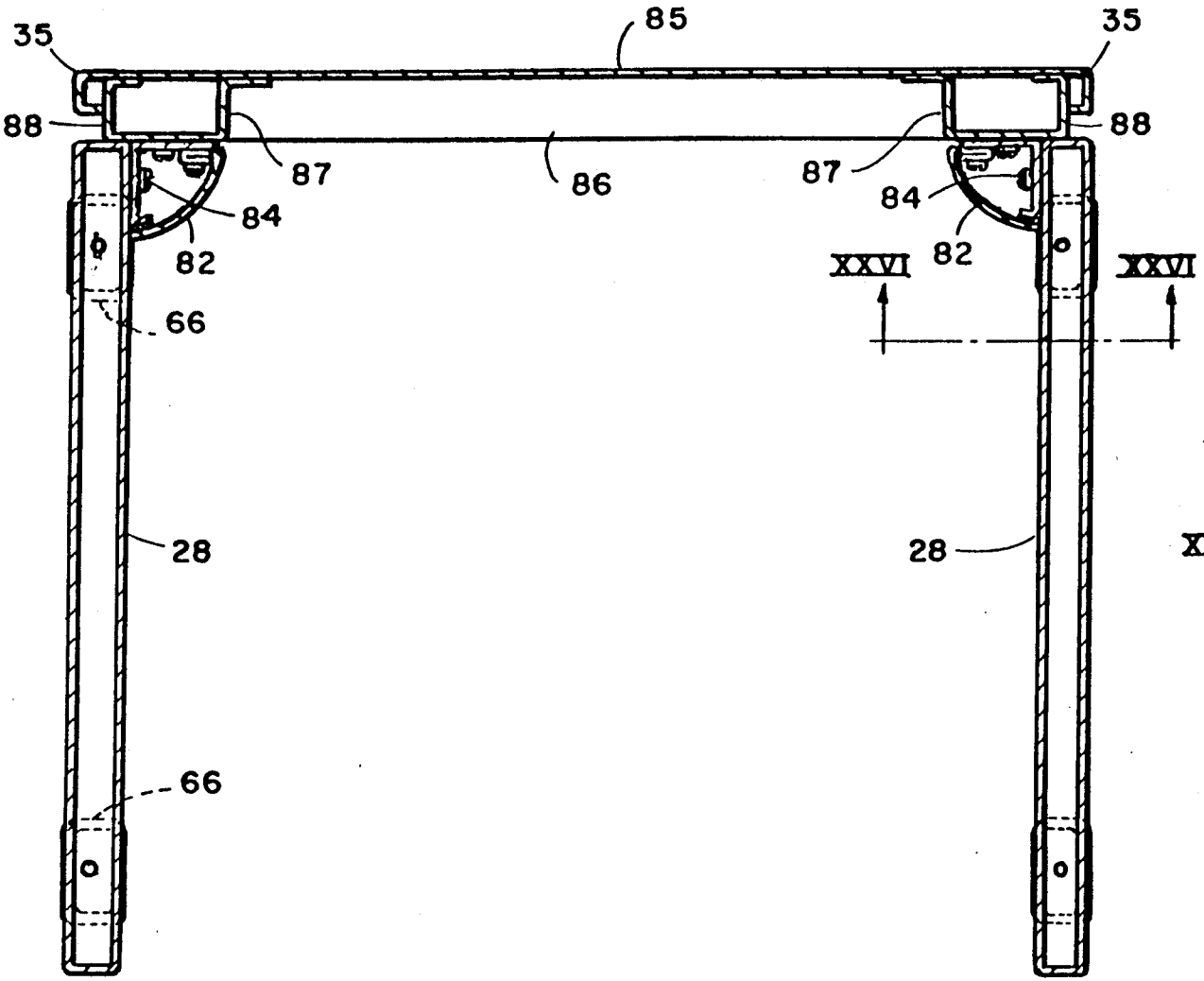
FIG. 25 is a horizontal cross-sectional view of the straight modular furniture unit, taken along the line XXV—XXV, FIG. 26.

With reference to FIG. 25, the illustrated back panel 35 has a hollow, formed sheet metal construction, comprising an exterior panel or face 85, with inwardly bent peripheral edges that form upper and lower channels 86, and opposite side channels 87. Side channels 87 include an inwardly bent lip or flange 88 which positions the exterior face 85 of back panel 35 outwardly a distance sufficient to form the recess 36 (FIG. 2) in which the floor track system 20 is received. As best illustrated in FIG. 18, a reinforcing channel 89 is attached to the interior of back panel face 85 between side channels 87 at the upper ends thereof, to rigidify back panel 35. A cable management trough or channel 90 is also attached to back panel 35 directly below reinforcing channel 89, and as best illustrated in FIG. 23, has a generally U-shaped configuration in which wiring and other cables may be received and retained. A strip of double faced adhesive foam tape (not shown) may be installed between the adjacent surfaces of channel 90 and back panel 35 for sound deadening and secure mounting. The exterior surfaces of back panel 35 may be fabric wrapped for ornamental purposes.

Figure 10:
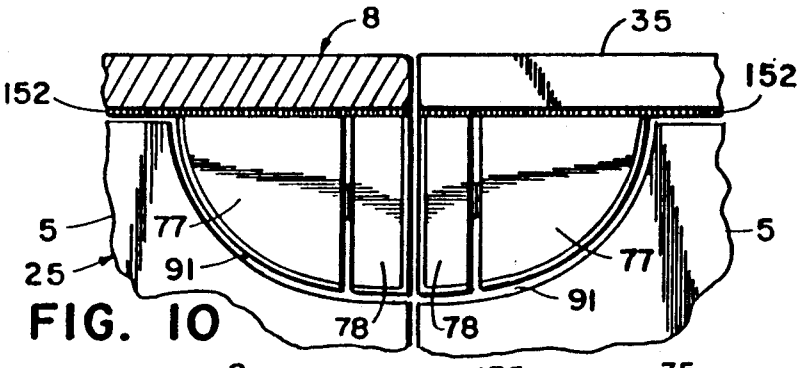
FIG. 10 is a fragmentary top plan view of two adjacent straight modular furniture units, with the post and grommet caps in place.
Figure 11:
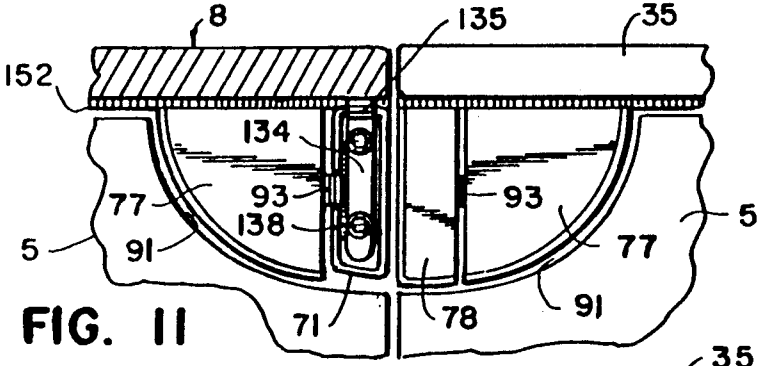
FIG. 11 is a fragmentary top plan view of the two adjacent straight modular furniture units shown in FIG. 10, with the grommet cap of the left-hand unit removed.
Figure 12:
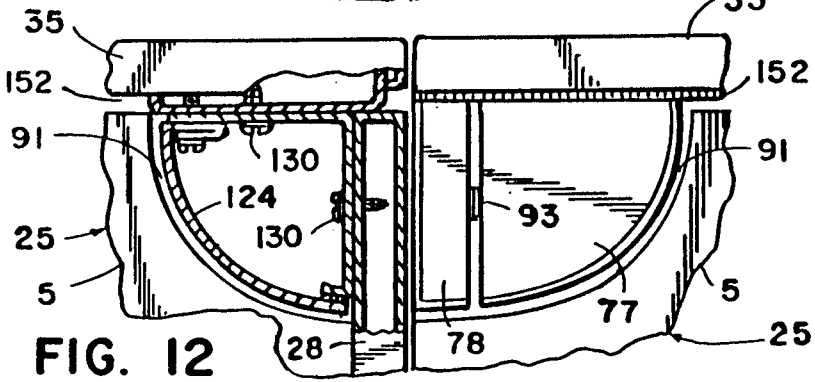
FIG. 12 is a fragmentary top plan view of the two adjacent straight modular furniture units shown in FIG. 10, with portions of the left-hand unit broken away to reveal internal construction.

With reference to FIGS. 15–17A, the illustrated post caps 77 have an arcuate plan shape that is similar to the shape of the curved corner edges 51 and 52 of worksurface panel 45. In this example, post caps 77 are in the shape of a quarter circle, and in combination with an adjacent grommet cap 78, generally cover the entire cutout corner area 6 of the worksurface panel 45. When assembled, the upper surfaces of post caps 77 and grommet caps 78 are generally parallel and flush with the upper surface of worksurface panel 45. As best illustrated in FIGS. 10–12, post caps 77 and grommet caps 78 are sized slightly smaller than worksurface cutouts 6 so as to form arcuate grooves 91 which are normally covered by flaps 54 through which wiring and cabling may be inserted. Post caps 77 (FIGS. 15-17) have a depending sidewall 92 extending completely around the marginal edge thereof, and a laterally extending arm or tab 3 having an inverted T shape. Tab 93 is shaped to be closely received within the side notch 76 of grommet 71 to removably and slidably mount post cover 77 over cutout area 6 on worksurface panel 45. The arcuate upper edge 94 of post cap 77 is rounded to a selected radius, and mates with the outer rounded marginal edges 94' of grommet cap 78.

The reference numeral 25*a* (FIG. 19) generally designates another embodiment of the straight surface unit 25, in which a pair of intermediate supports 14 are provided instead of end panels 28. Since straight surface unit 25*a* is otherwise similar to the previously described straight surface unit 25, similar parts appearing in FIGS. 18 and 19 respectively are represented by the same, corresponding reference numeral, except for the suffix "a" in the numerals of the latter. The illustrated intermediate supports 14 have a hollow, formed sheet metal construction, with a generally inverted L-shaped side elevational configuration, comprising inner and outer side faces 95 and 96 respectively, and marginal edges 97-100. The top edge 97 of intermediate support 14 includes a square notch 101 therethrough to facilitate routing wires, cables, and the like between adjacent furniture units 4. A groove or slot 102 is formed through the front edge 99 of intermediate support 14, and terminates in a hook shaped retainer or pocket 103 in which cabling and wiring may also be routed and supported beneath worksurface panel assembly 44*a*. An L-shaped bracket 104 is attached to the inner face 95 of intermediate support 14 by fasteners 105. The upper legs of brackets 104 are attached to the lower surface 46*a* of worksurface panel assembly 44*a*, so as to securely interconnect the same. Similar to end panel 28, intermediate support 14 also includes adjustable glides 64*a* mounted by glide plate 65*a*, and glide shield 66*a*. Also provided are U-shaped shipping brackets 67*a*, as well as L-brace 80*a*, cover 82*a*, gusset 83*a* and grommet 71*a* with covers 77*a* and 78*a*. The modular construction of intermediate support 14 and connector bracket 104 provides a non-handed arrangement, such that intermediate support 14 can be attached to either end of a worksurface panel 45 by simply reversing the position of connector bracket 104.

Figures 27, 28:
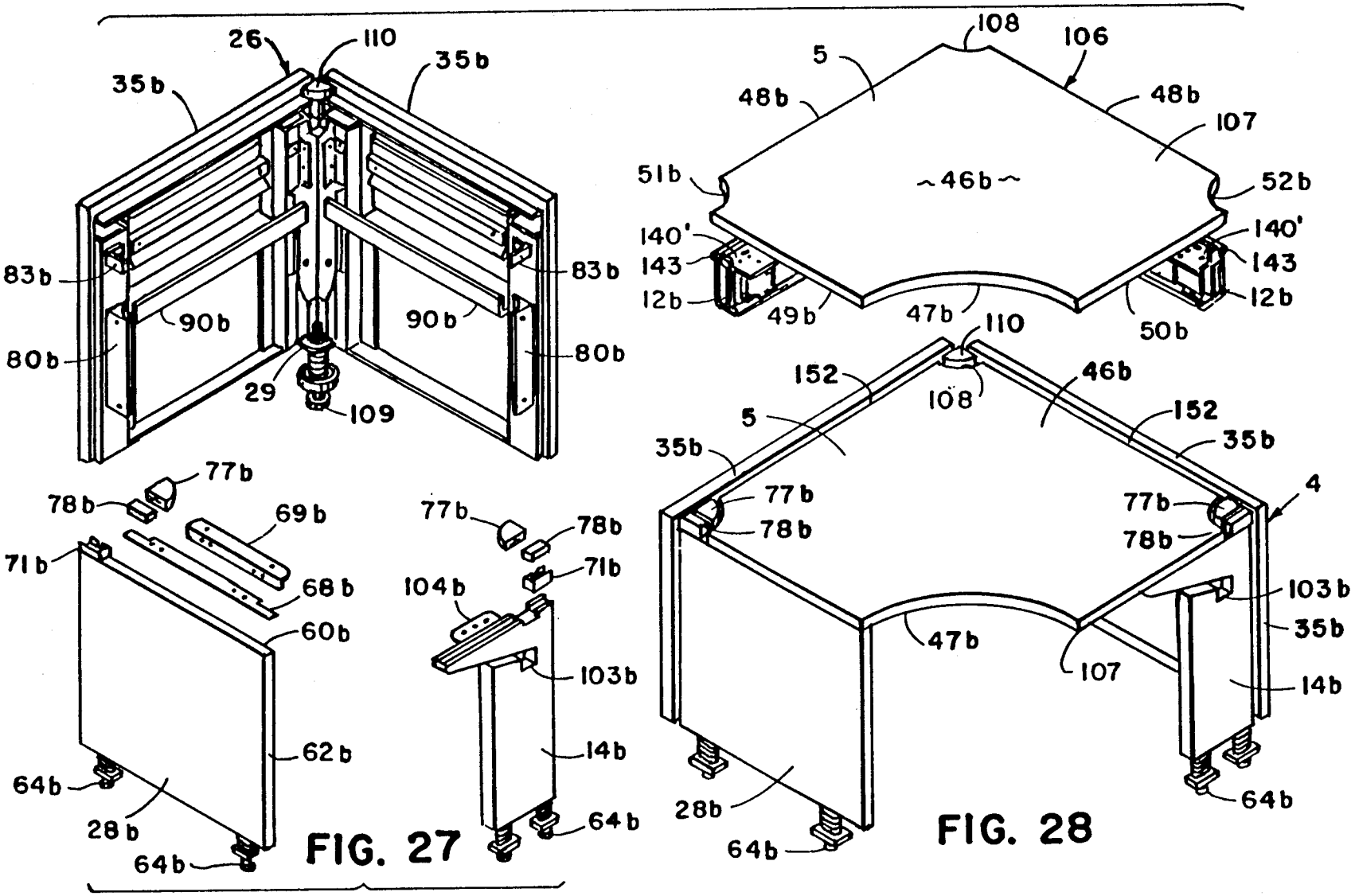
FIG. 27 is an exploded perspective view of a corner modular furniture unit.
FIG. 28 is a perspective view of an assembled corner modular furniture unit.

The corner surface unit 26 illustrated in FIGS. 27 and 28 has six basic components, comprising a corner worksurface assembly 106, an end panel 28*b*, an intermediate support 14*b*, a pair of back panels 35*b*, and a corner leg 29. Since corner surface unit 26 includes certain components similar to straight surface unit 25, common parts appearing in FIGS. 18 and 27-28 respectively are represented by the same corresponding reference numeral, except for the suffix "b" in the numerals of the latter.

Corner worksurface assembly 106 includes a curved worksurface panel 107 having flat upper and lower surfaces 46*b*, perpendicularly intersecting rear edges 48*b*, end edges 49*b* and 50*b*, and curved front edge 47*b*. The rearward corners of worksurface panel 107, formed by the intersection of edges 48*b*, 49*b* and 50*b* are cut out, and define curved edges 51*b*, 52*b* and 108.

End panel 28*b*, intermediate support 14*b* and back panels 35*b* are fastened to the lower surface 46*b* of worksurface panel 107 in a manner similar to straight worksurface panel 45, except that corner leg 29 interconnects the outboard ends of back panels 35*b*. Corner leg 29 has a generally L-shaped top plan configuration, with opposite flanges thereof fastened to the side channels 87*b* of adjacent back panels 35*b*. A vertically adjustable foot 109 is mounted in the lower portion of corner leg 29, and a special post cap 110 is mounted in the top of corner leg 29.

The bullet conference unit 27 illustrated in FIG. has five basic components, comprising an elongated worksurface assembly 111, an intermediate support 14*c*, a conference leg 30, a back panel 35*c*, and a column pedestal 112. Since bullet conference unit 27 includes certain components similar to straight surface unit 25 and corner surface unit 26, common parts appearing in FIGS. 18-28 and 2 respectively are represented by the same corresponding reference numeral, except for the suffix "c" in the numerals of the latter.

Figure 19:
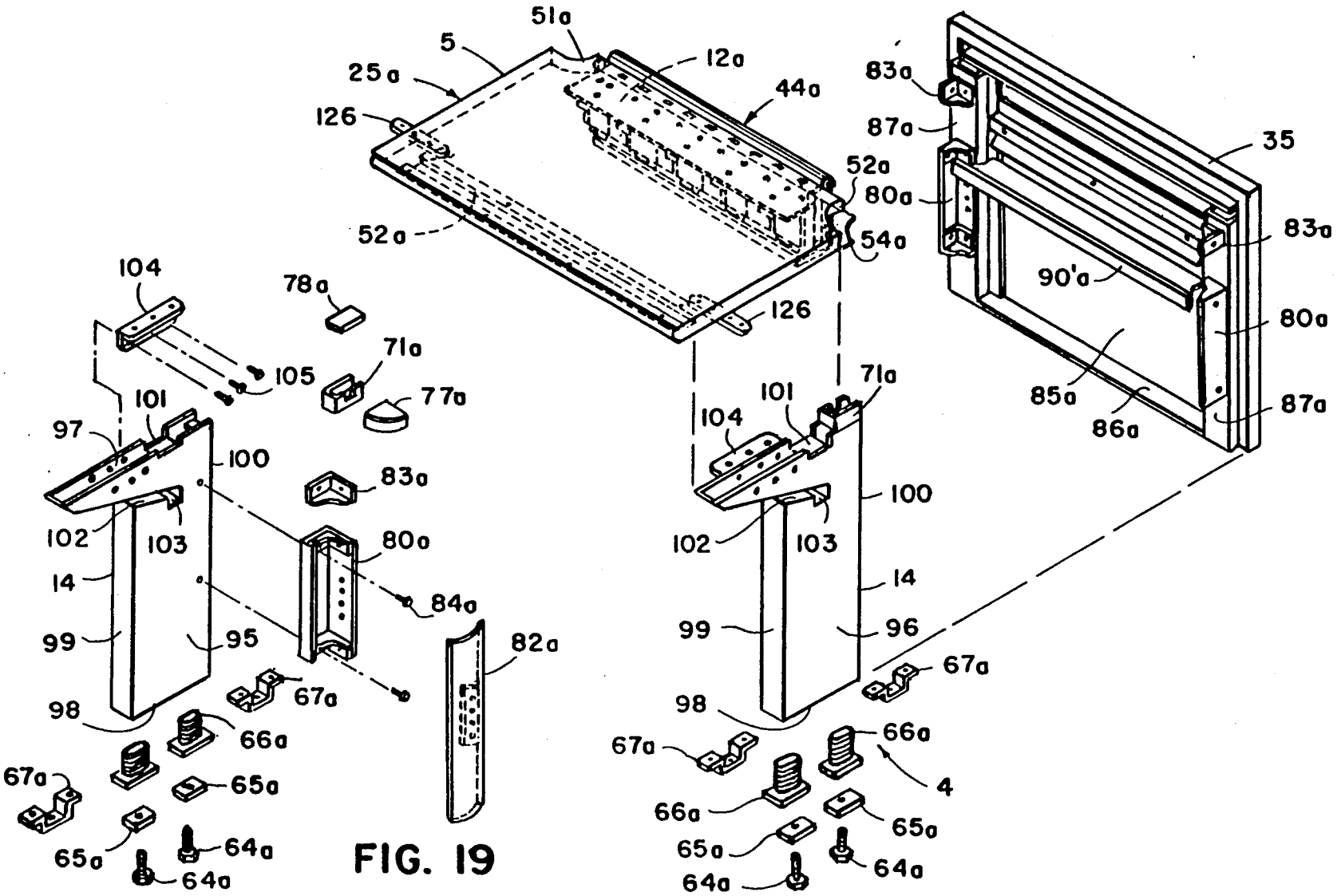
FIG. 19 is an exploded perspective view of the straight modular furniture unit, shown with two intermediate supports.

All of the modular furniture units 4, including furniture units 25, 26 and 27, have a common height and are configured to mate with one another in a freestanding, side-by-side fashion to create various style workstations 11. Preferably, adjacent modular furniture units 4 are positively interconnected by means such as the illustrated connector plates or links 126 (FIG. 19). Also, adjacent intermediate legs 14 (FIG. 24) are preferably interconnected by through bolts 84'.

Figures 35, 36, 37, 38:
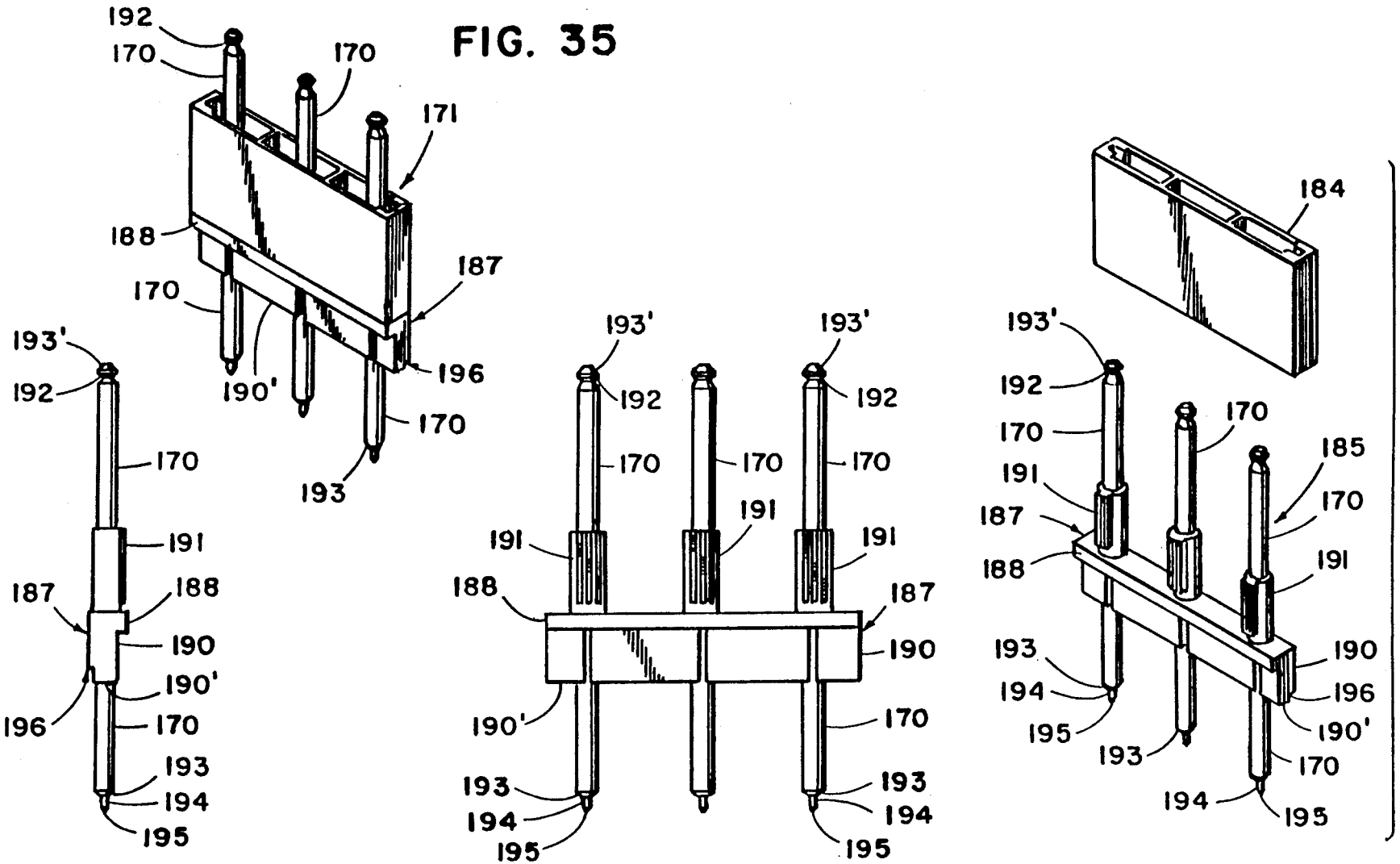
FIG. 35 is a perspective view of a stanchion portion of the present invention.
FIG. 36 is a side elevational view of the stanchion.
FIG. 37 is a front elevational view of the stanchion.
FIG. 38 is an exploded perspective view of the stanchion.

With reference to FIGS. 3 and 35, overhead cabinet 7 has a generally rectangularly shaped case, comprising a top panel 113, a bottom panel 114, a rear panel 115, opposite end panels 116, and a hinged door 117. Cabinet 7 has a formed sheet metal construction, which includes an integrally shaped marginal frame which rigidifies the case. The bottom panel 114 is inset upwardly so as to form a recess to facilitate mounting the same in the manner described below.

A pair of rigid, transaction mounting posts 118 (FIG. 3) are provided to mount or support cabinet 7 over the associated worksurface 45. In the illustrated example, each transaction post 118 has a substantially inverted L-shaped side elevational configuration, comprising an upper leg 119 and a lower leg 120. The lower leg 120 of transaction post 118 has an L-shaped top plan configuration with in-turned side flanges 121. Fastener apertures 122 and 123 are provided in the upper and lower legs 119 and 120 respectively of transaction posts 118, and are adapted to receive fasteners therethrough as described hereinafter. Arcuately shaped covers 124 attach to the side flanges 121 of transaction posts 118, and serve to cover the open faces thereof to form wireways.

Figure 7:
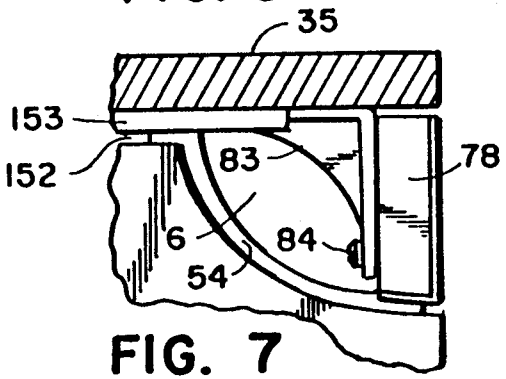
FIG. 7 is a fragmentary top plan view of the straight modular furniture unit, with the post cap removed.
Figure 8:
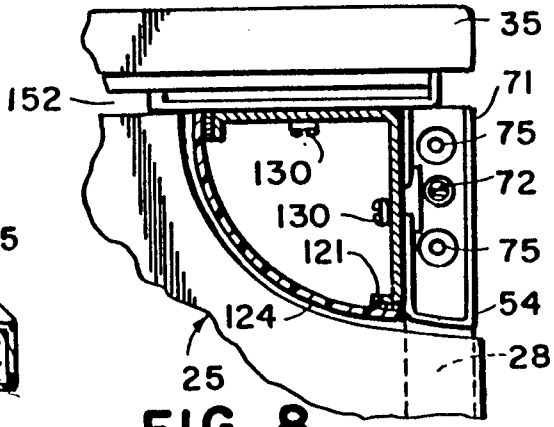
FIG. 8 is a vertical cross-sectional view of the straight unit, taken through the transaction post, with the post and grommet caps removed.
Figure 4:
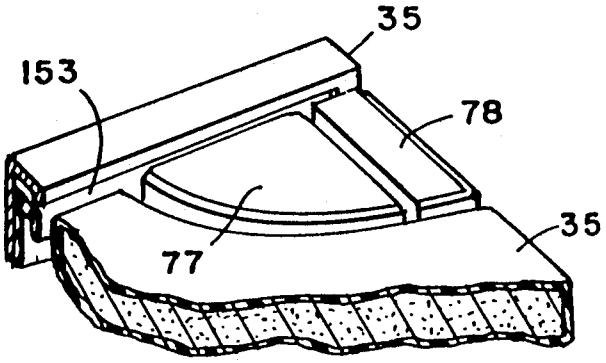
FIG. 4 is a fragmentary, perspective view of a corner portion of the straight modular furniture unit.
Figure 5:
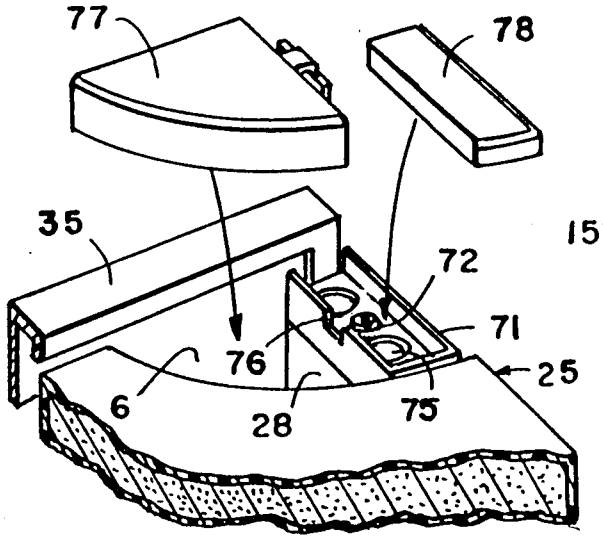
FIG. 5 is a fragmentary perspective view of the straight modular furniture unit illustrated in FIG. 4, with post cap and grommet cap portions thereof exploded away to reveal internal construction.
Figure 56:
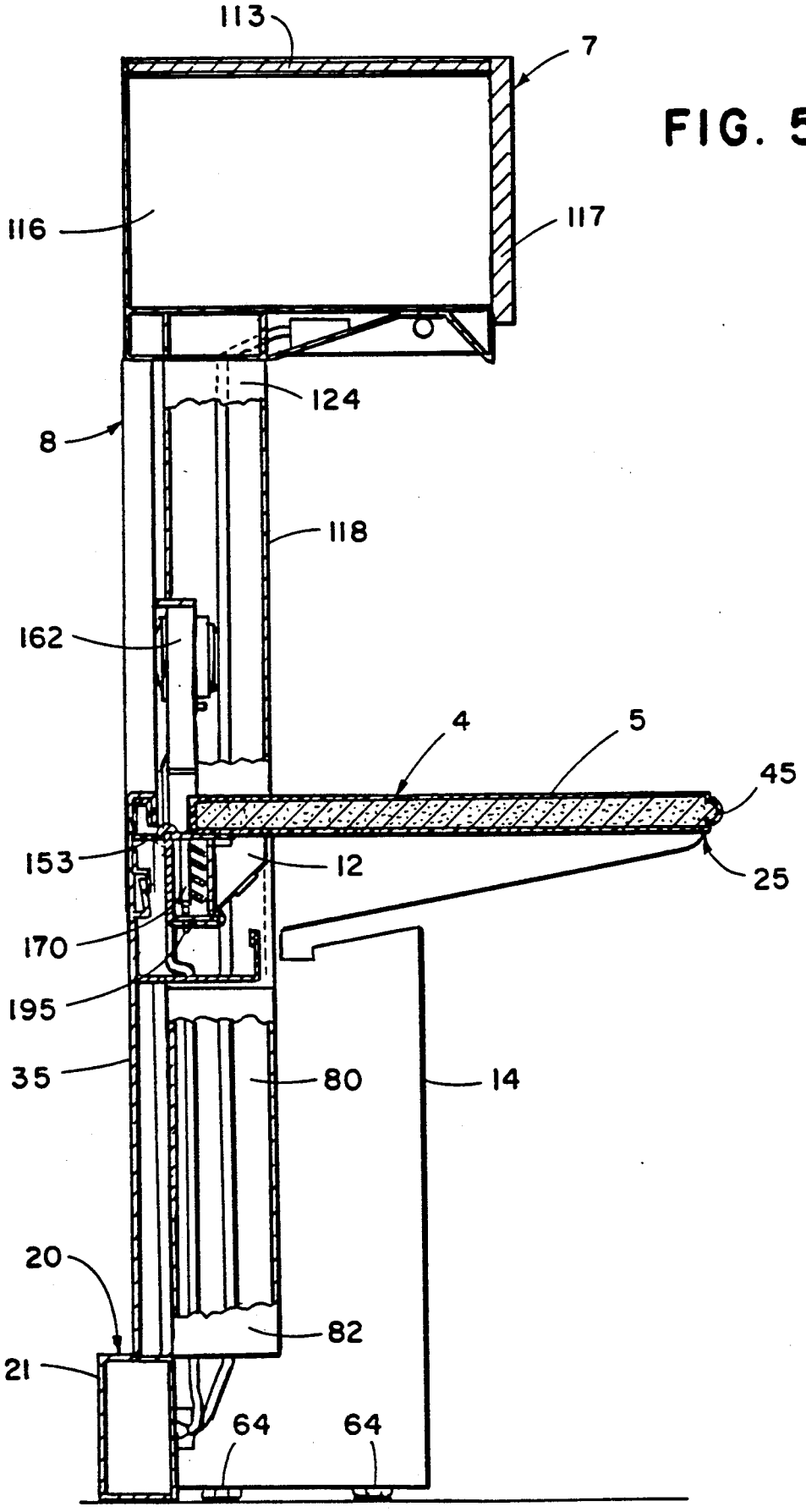
FIG. 56 is a vertical cross-sectional view of a straight modular furniture unit with assembled overhead cabinet, wherein portions thereof are broken away to reveal internal construction.

Overhead cabinets 7 are attached to an associated furniture unit 4 in the following manner. The post caps 77 at the opposite rear corners of worksurface 5 of the furniture unit 4 are removed by pulling them upwardly out of engagement with the associated grommet 71, so as to fully expose the cutouts 6 in the worksurface 5, as illustrated in FIG. 7. A pair of transaction posts 118 are inserted through the cutouts 6 in worksurface 5, and positioned so that they assume a substantially vertical orientation. In the example of a straight unit 25, the lower ends of vertical transaction post legs 120 are attached to the interior surfaces 58 of the end panels 28, and to back panel 35 by inserting fasteners 130 through associated apertures 122. The upper horizontal legs 119 of transaction posts 118 are positioned within the recess in the bottom 114 of overhead cabinet 7, and are attached by inserting fasteners (not shown) through associated apertures 123. Covers 124 are then positioned over the open faces of transaction posts 118, so as to form a channel in which wiring and/or other utilities may be routed from underneath worksurface panel 45 to the recess in the lower portion of overhead cabinet 7, in the manner illustrated in FIG. 56. Transaction posts 118 are aligned with the rear portion of overhead cabinet 7 so as to support the same in a cantilevered fashion over worksurface panel 45.

Countertop unit 40 (FIG. 2) includes a flat, rigid top 131, with a pair of support posts 132 depending from opposite ends of top 130. Support posts 132 are similar in shape and construction to the vertical legs 120 of transaction posts 118, and mount to straight furniture unit 25 in an identical fashion. Support posts 132 position top 131 a preselected distance above Worksurface panel 45, and include arcuate covers 133.

Figure 9:
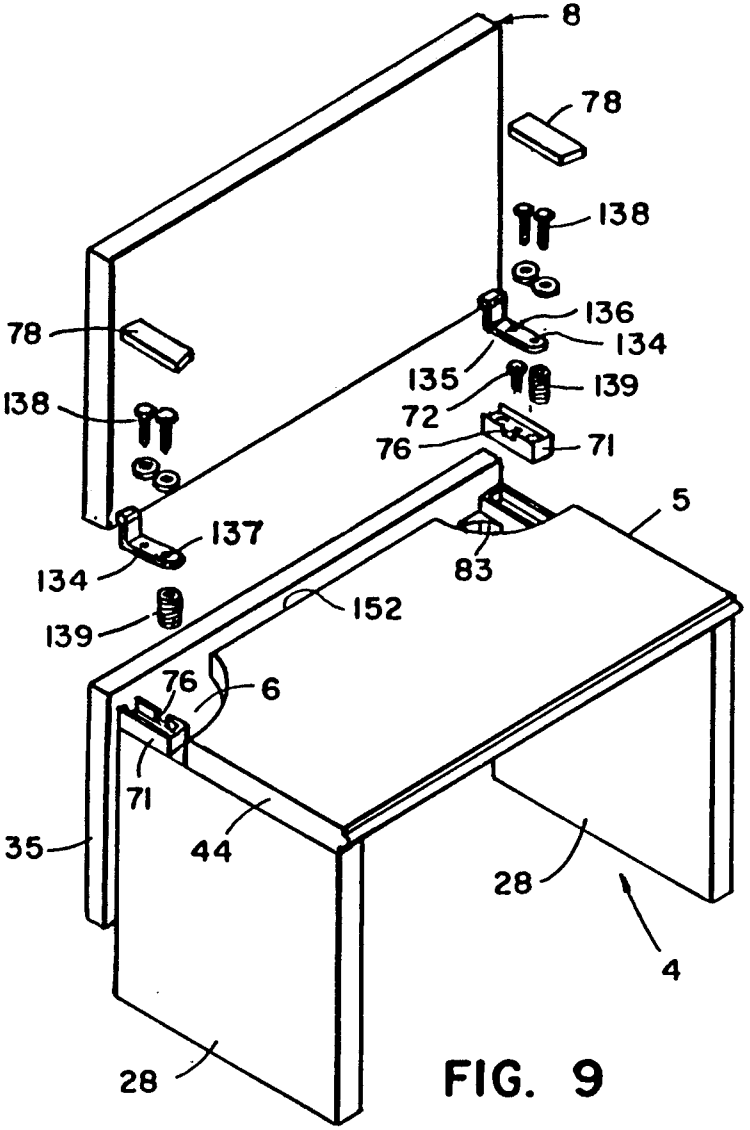
FIG. 9 is an exploded perspective view of the straight modular furniture unit and an associated privacy screen assembly.
Figure 15:
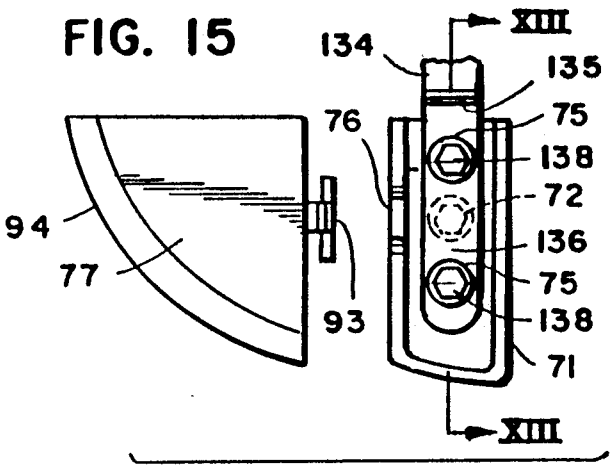
FIG. 15 is an exploded top plan view of the post cap and an associated grommet.
Figure 16:
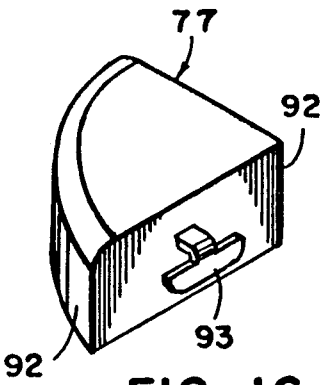
FIG. 16 is a perspective view of the post cap.
Figure 14:
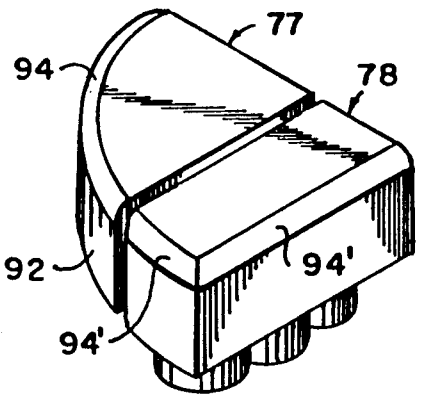
FIG. 14 is an exploded fragmentary vertical cross-sectional view of the straight modular furniture unit, particularly showing attachment of the privacy screen assembly.
Figure 14:
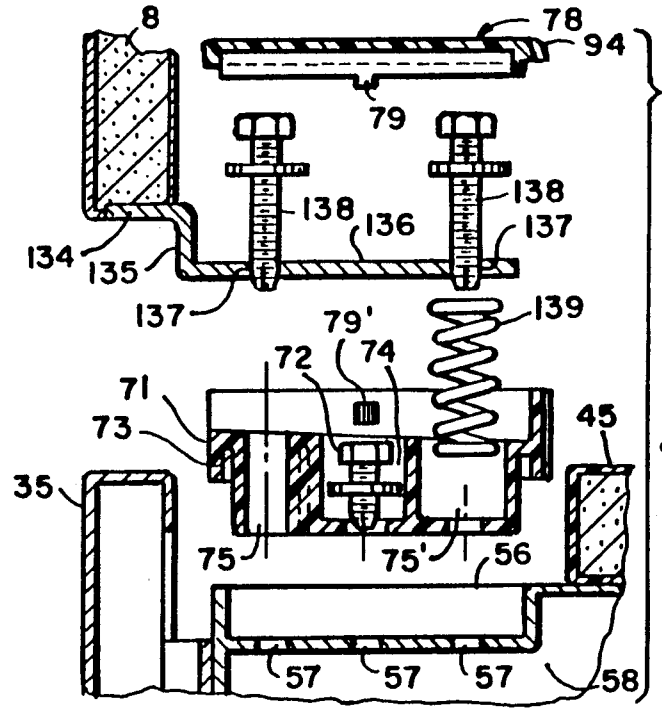

Privacy screen 8 (FIG. 9) has a generally rectangular front elevational shape, which is configured to match with an adjacent back panel 35. Preferably, a number of privacy screens 8 are provided in different widths and heights to accommodate various applications and open office plans. The illustrated privacy screen 8 includes a pair of mounting brackets 134 positioned at the opposite sides of privacy screen 8, which extend forwardly toward the front edge 47 of worksurface 45. Mounting brackets 134 have a downwardly bent neck 135, and a flat base 136 which is shaped to be closely received within the top recess or socket of an associated grommet 71. The base 136 of each mounting bracket 135 has a pair of apertures 137, positioned for vertical alignment with apertures 75 and 75' of grommet 71, as shown in FIGS. 13 and 14. In the illustrated example, a pair of fasteners 138 attach each mounting bracket 134 and associated grommets 71 to the end panel 28. A coil spring 139 is positioned between the rear portion of grommet 71 and end panel 28, and in conjunction with the angled orientation of grommet mounting surface 73 facilitates adjusting the vertical position of privacy screen 8 by adjusting fasteners 138, and also serves to resist transmitting impact forces directly from privacy screen 8 to the associated furniture unit 4.

In operation, privacy screen 8 is attached to a furniture unit, such as the illustrated straight unit 25, in the following manner. The grommet caps 78 on opposite sides of furniture unit 25 are first removed from the associated grommets 71 by unsnapping the same. The privacy screen 8 is then positioned directly above and over the back panel 35 of furniture unit 25, with mounting brackets 134 aligned with grommet bases 71. Foot covers (not shown) may be provided to cover the exposed areas on the neck portions 135 of screen mounting brackets 134, and color coordinate with the grommets 72 for improved aesthetics. Fasteners 138 are then inserted through apertures 137 of mounting brackets 134 and apertures 75 and 75' of grommets 71 into threaded bores 57 in the bottom of end panel socket 56. The fasteners 138 illustrated in FIGS. 13–17A comprise hexagonal head bolts, but other types of fasteners, such as round head machine screws, may also be used. Grommet caps 73 are then reattached to the upper marginal edges of grommets 71 by snapping them in place to cover fasteners 138, as shown in FIG. 10. Since the privacy screens 8 are supported solely by the furniture units 4, they serve to partition off the office space 2, independent of a partition panel system.

A corner privacy screen 41 (FIG. 2) is also provided for corner surface units 26. Corner privacy screen 41 is substantially identical to straight privacy screen 8, except one end edge is beveled to mate with a similar corner screen 41, and the adjacent mounting bracket 134 is bent downwardly to fasten to the upper end of corner leg 29 with a special fastener (not shown). Corner privacy screen 41 otherwise attaches to corner surface unit 26 in a fashion similar to that described above in conjunction with straight screen 8.

Figures 29, 30, 31:
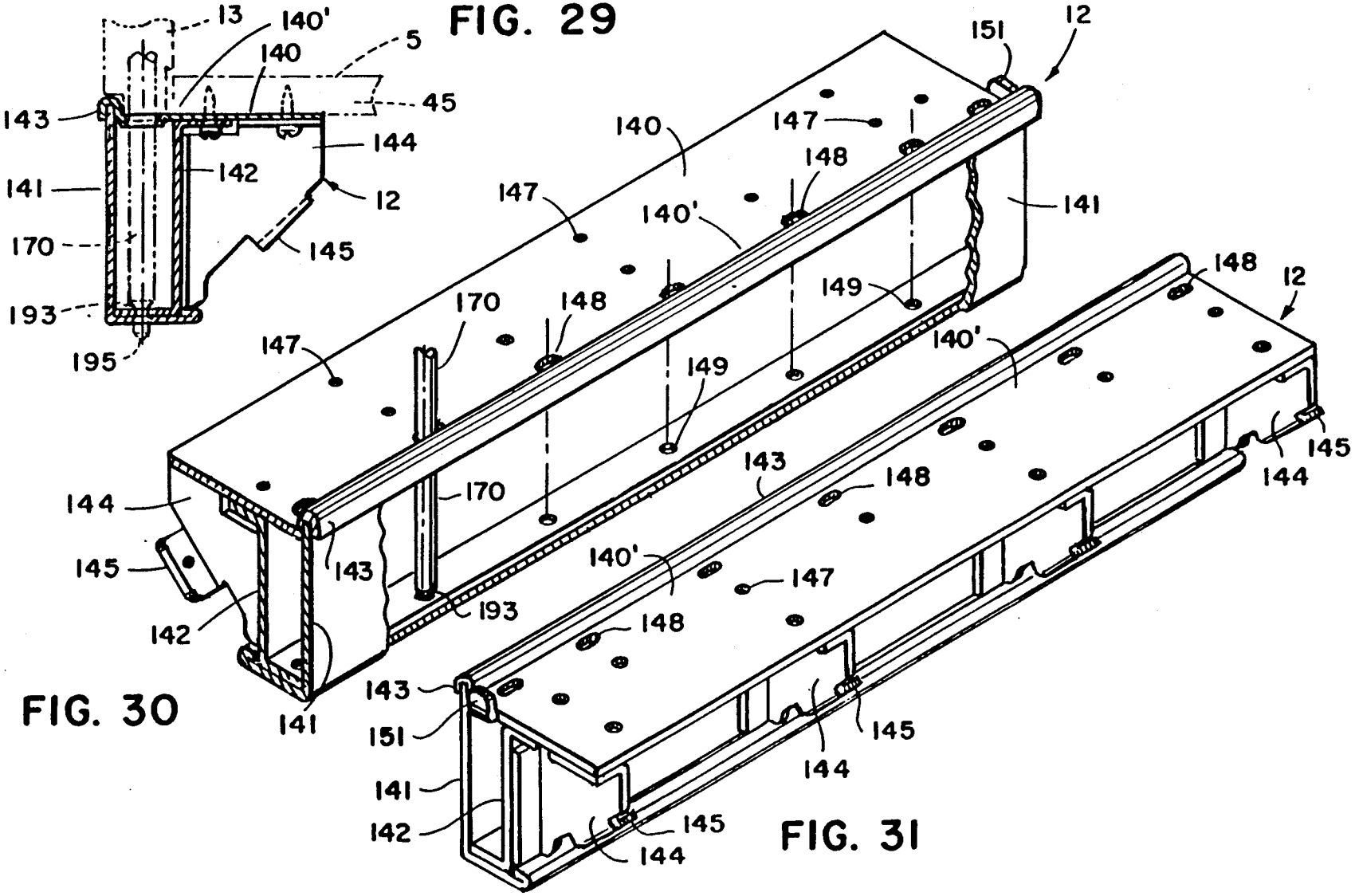
FIG. 29 is a vertical cross-sectional view of the amenity mounting rail.
FIG. 30 is a fragmentary, rear perspective view of the amenity mounting rail, wherein portions thereof are broken away to reveal internal construction.
FIG. 31 is a fragmentary, front perspective view of the amenity mounting rail.

The illustrated amenity rail 12 (FIGS. 29–31) is in the form of a weldment assembly, comprising an upper channel 140, a rear channel 141, and an inner channel 142. The rearward edge 143 of upper channel 140 is rolled over to form a U-shaped slot in which the upper edge of front channel 141 is received and captured. It is to be understood that the U-shaped slot may alternatively be formed on the upper edge of rear channel 141 to capture the rear edge of upper channel 140. In either such arrangement, a portion of the uppermost surface of upper channel 140 which is disposed adjacent apertures 148 defines a ledge or abutment surface 140' on which amenity units 13 are supported in the manner discussed in greater detail below. Inner channel 142 has a Z-shaped end configuration, extends between upper channel 140 and rear channel 144, and is rigidly interconnected with the same by means such as welding or the like to form a rigid integral assembly. Triangular gussets 144 are also fastened between upper channel 140 and inner channel 142 to further rigidify the assembly, and in the illustrated example, include apertured tabs 145 to which wire manager rings or straps 146 (FIG. 32) may be attached with a snap fit. The upper channel 140 (FIGS. 29–31) of amenity rail 12 also includes a plurality of fastener apertures 147, and obround mounting apertures 148 therethrough. Obround mounting apertures 148 are spaced generally evenly or uniformly along the length of amenity rail 12, with their longer dimension oriented longitudinally therealong. A mating aperture 149 is disposed generally below each obround mounting aperture 148, and extends through the lower webs of inner channel 144 and rear channel 141. Each pair of mounting apertures 148 and 149 is adapted to receive and retain therein a mounting end portion of an amenity unit 13, as described in greater detail hereinafter. The illustrated lower mounting apertures 149 have a generally circular plan shape, and are sized slightly smaller than the shortest dimension of their mating upper mounting aperture 148. The mounting apertures 148 and 149 are generally vertically aligned, and may be offset slightly to position the amenity unit 13 at a small rearward angle, in the nature of 5°, so that when the amenity unit 13 is loaded, the planar support surfaces of the amenity unit assume a substantially horizontal orientation.

Figure 33:
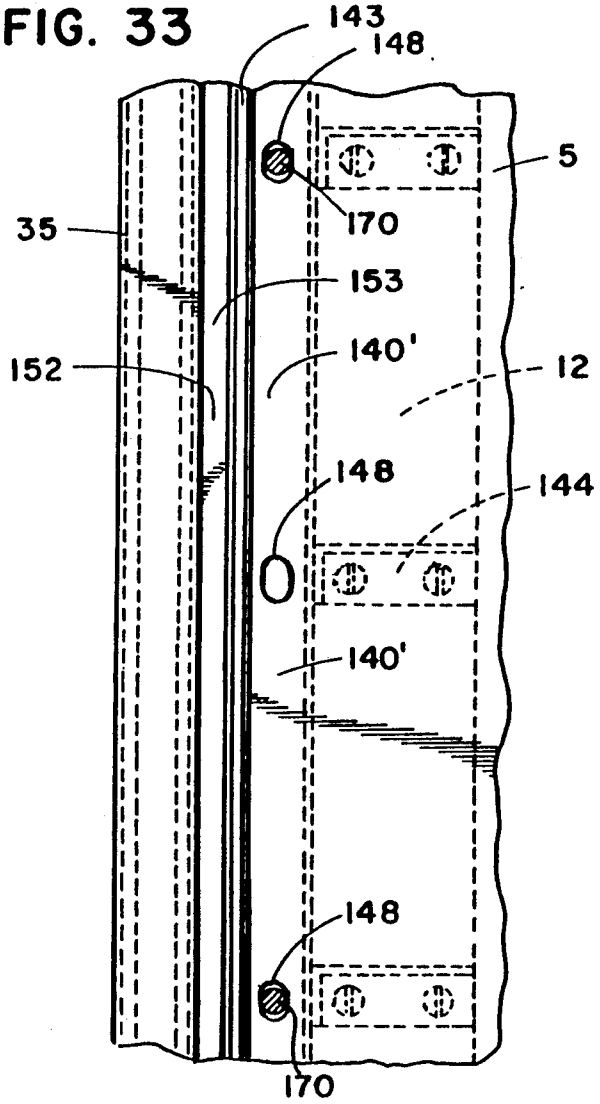
FIG. 33 is a fragmentary top plan view of the straight modular furniture unit, particularly showing the amenity mounting rail and attached amenity unit.
Figure 32:
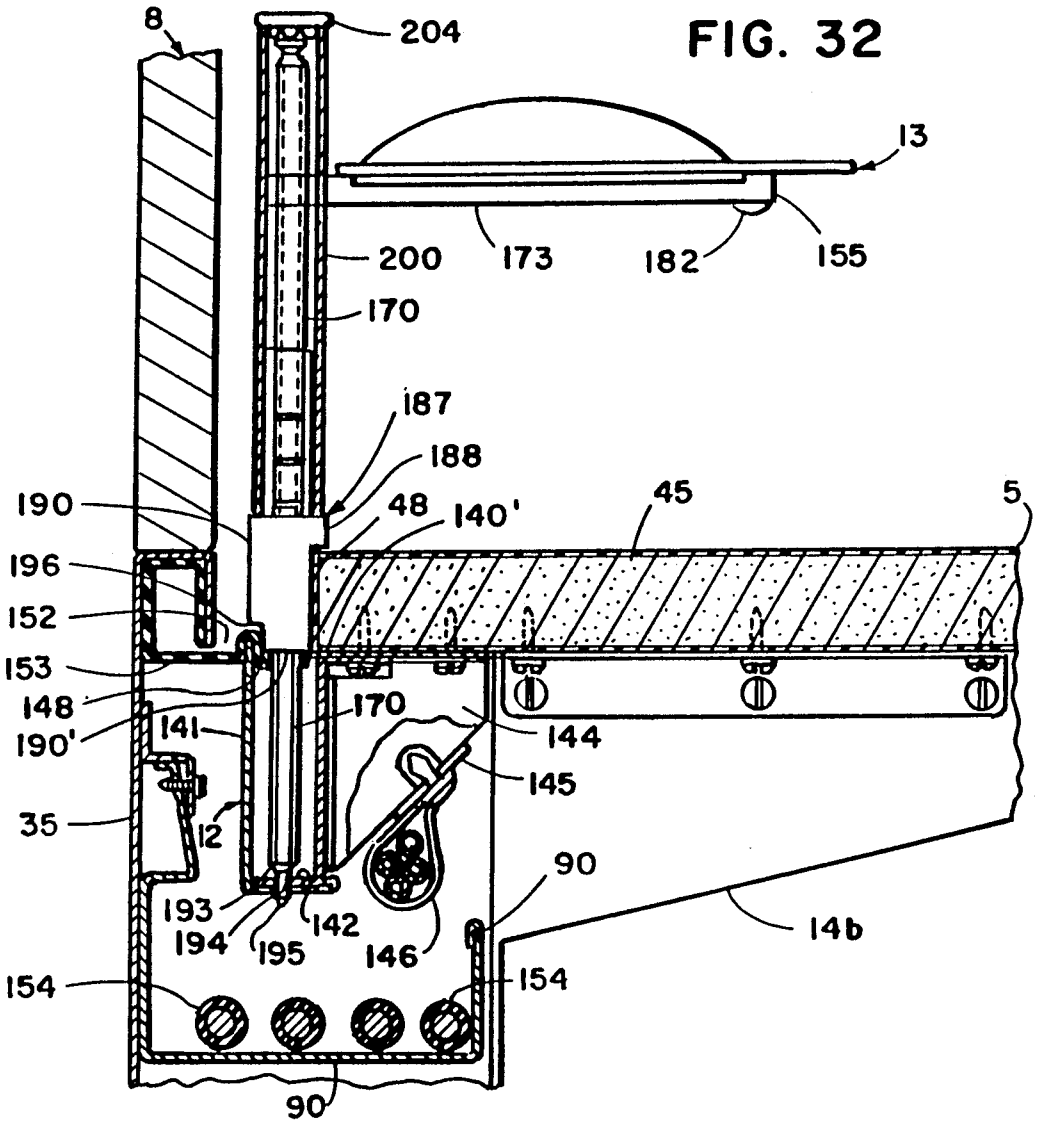
FIG. 32 is a fragmentary vertical cross-sectional view of the straight modular furniture unit, particularly showing mounting a non-convertible amenity unit in the amenity mounting rail.

Each different style of worksurface 5 includes at least one section of amenity mounting rail 12 positioned along a rearward edge of the worksurface. In the case of a straight surface unit 25 (FIGS. 20 and 22–23), a single length of mounting rail 12 extends along the rearward edge 48 of worksurface panel 45, between arcuate marginal edges 51 and 52. Mounting rail 12 is attached to the lower surface 46 of worksurface panel 45 by threaded fasteners 150. Upstanding tabs 151 are located on opposite ends of mounting rail 12, and abut the rearward edge 48 of worksurface panel 45 so as to properly position mounting rail 12 in a predetermined fore-to-aft relationship with worksurface panel 45. With reference to FIGS. 32 and 33, the two sets of mounting apertures 148 and 149 in mounting rail 12 are disposed just rearwardly of the rear edge 48 of worksurface panel 45, so that they are fully accessible to insert amenity units 13 therein. The forwardmost edge of mounting rail 12 is spaced a predetermined distance from the interior surface of back panel 35 to form a channel shaped space or slot 152 through which wires or cables, such as conductors 154, may be inserted for reception in wire manager trough 90. A flexible channel shaped extrusion 153 is mounted in the upper channel 86 of back panel 35, and includes a forwardly projecting flange or flap which normally covers slot 152. The opposite ends of extrusion 153 are shaped to butt up against the arcuate flaps 54 (FIG. 22) fastened to the lower surface 46 of worksurface panel 145. As illustrated in FIGS. 10–12, the straight worksurface slot 152, in combination with the two adjacent arcuate slots 91, form a continuous, covered wireway access groove along the rear edge of the worksurface panel 45, which communicates with the wireway access groove of adjacent furniture units 4. The ends of slots 152 are blocked by grommets 71 with associated screen mount 134 and transaction posts 118, such that arcuate slots 91 route wires around these end areas. Hence, wiring and cabling can be easily routed along the worksurfaces 4 about a workstation 11 to meet specific electrical needs and tasks.

As best illustrated in FIGS. 27 and 28, corner surface unit 26 has two lengths of mounting rail **12*b* positioned along both of the rearward edges 48*b* of worksurface 45*b*, and extending between marginal edges 51*b*, 108 and 52*b* respectively. Mounting rails 12*b* are substantially identical in construction and location to straight unit mounting rail 12**, such that further description of the same is not believed necessary to the understanding of their function.

Figure 46:
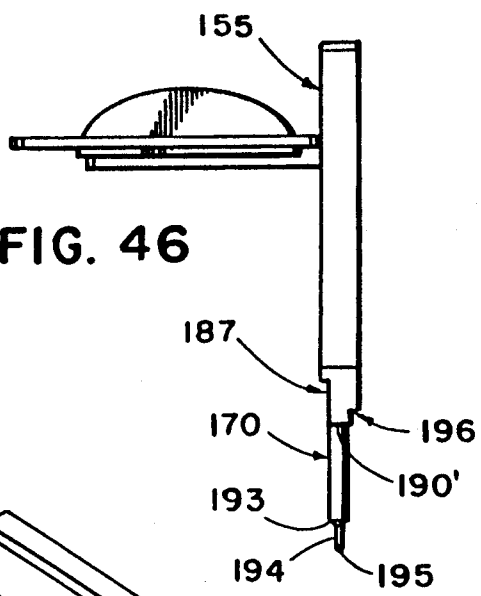
FIG. 46 is a side elevational view of the secondary shelf amenity unit.
Figure 45:
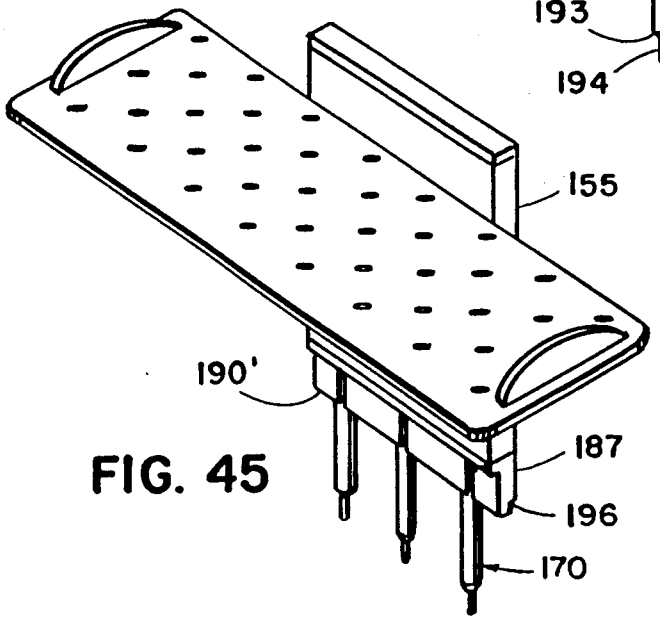
FIG. 45 is a perspective view of the secondary shelf amenity unit.
Figure 44:
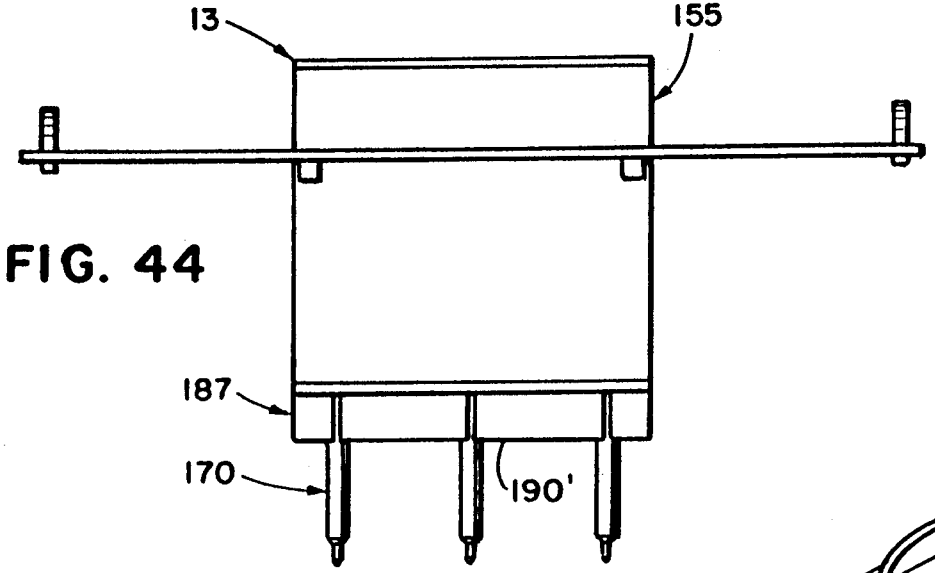
FIG. 44 is a front elevational view of a secondary shelf amenity unit.
Figure 48:
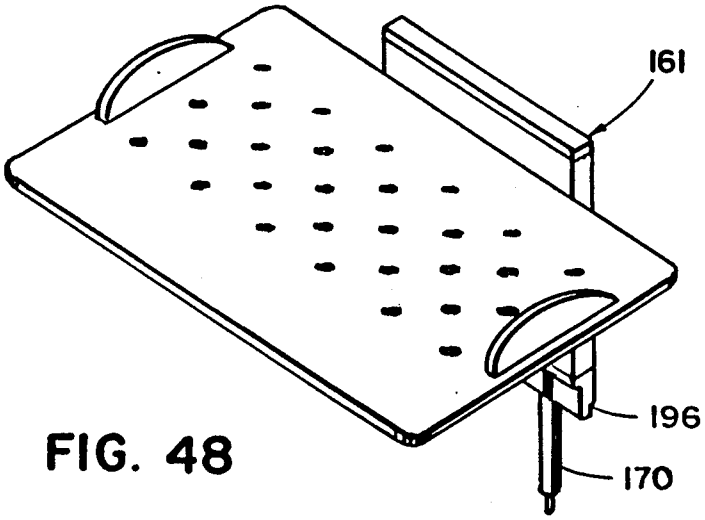
FIG. 48 is a perspective view of a telephone/utility tray amenity unit.
Figure 47:
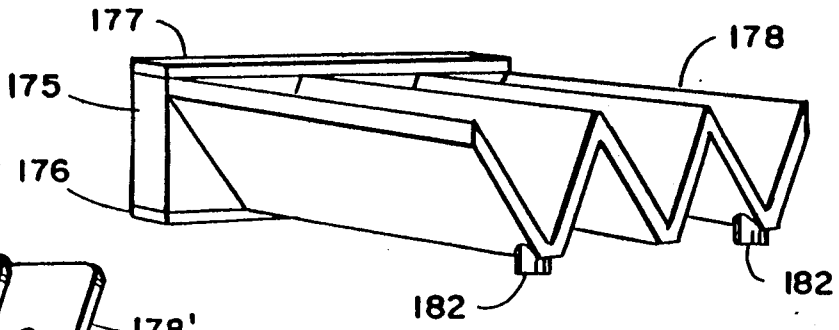
FIG. 47 is a perspective view of the diagonal paper manager amenity unit, shown attached to a stanchion.
Figure 47:
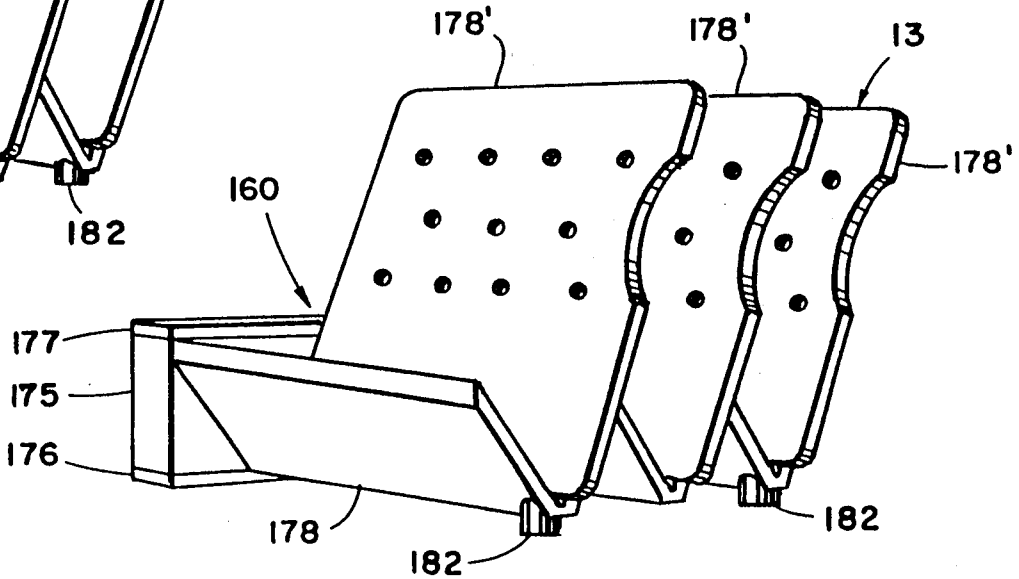
Figure 47:
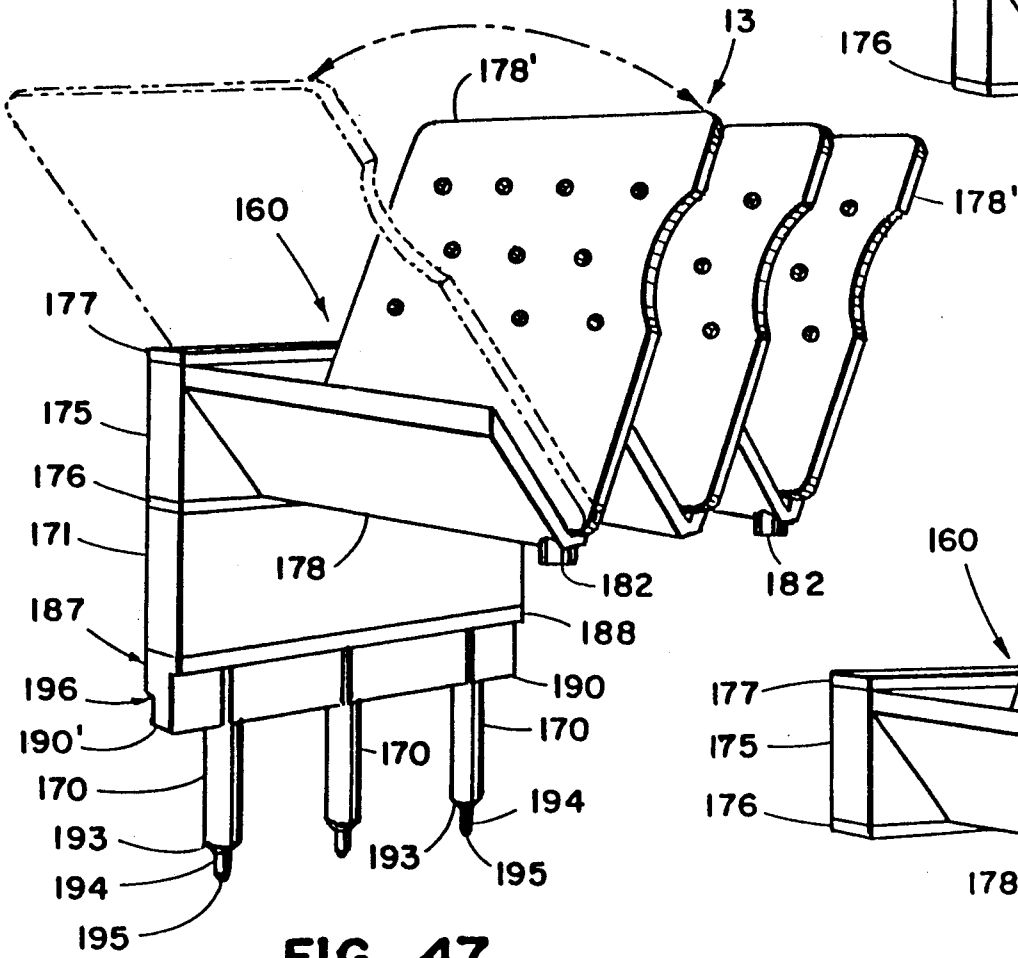
Figure 51:
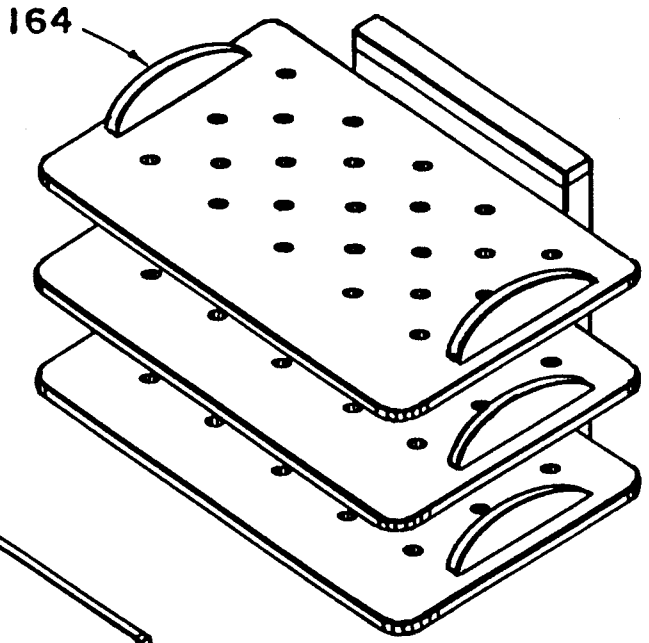
FIG. 51 is a perspective view of a three tray horizontal paper manager amenity unit.
Figure 50:
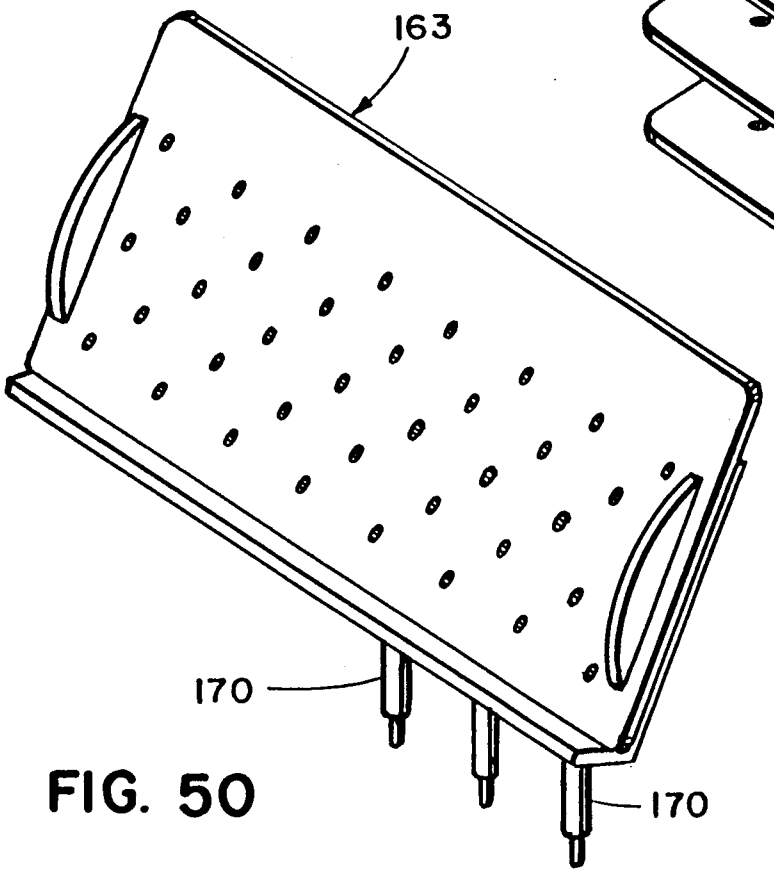
FIG. 50 is a perspective view of an angled display amenity unit.
Figure 49:
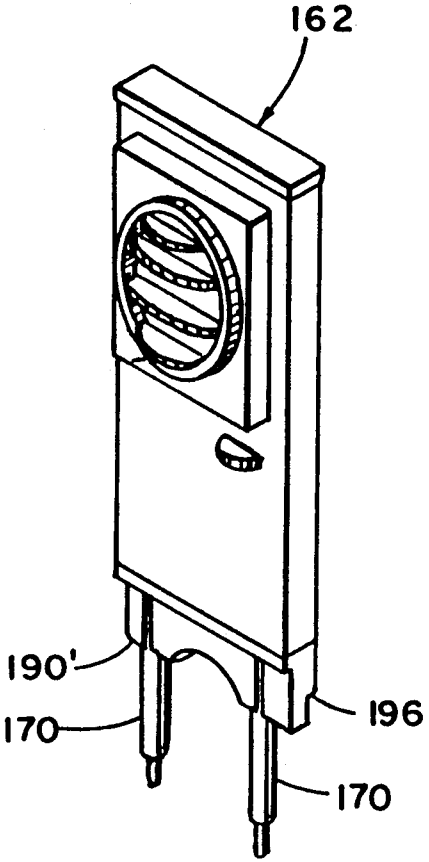
FIG. 49 is a perspective view an electric fan amenity unit.
Figure 54:
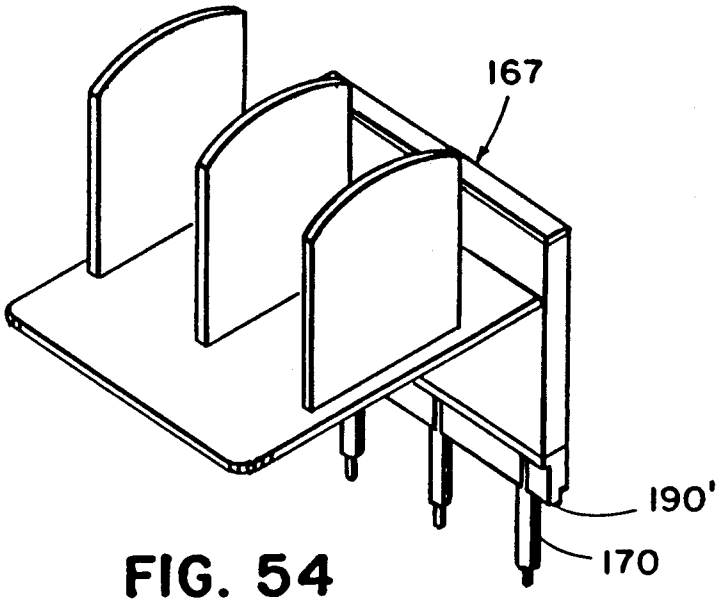
FIG. 54 is a perspective view of the binder bin amenity unit.
Figure 55:
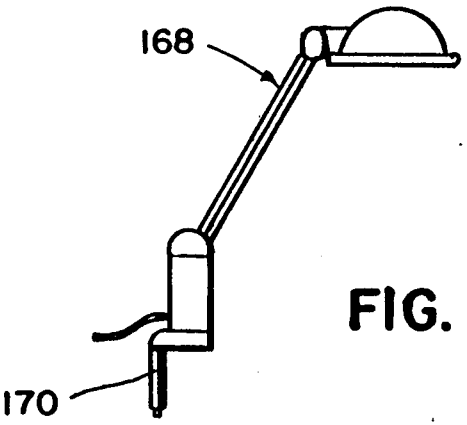
FIG. 55 is a perspective view of a task lamp amenity unit.
Figure 52:
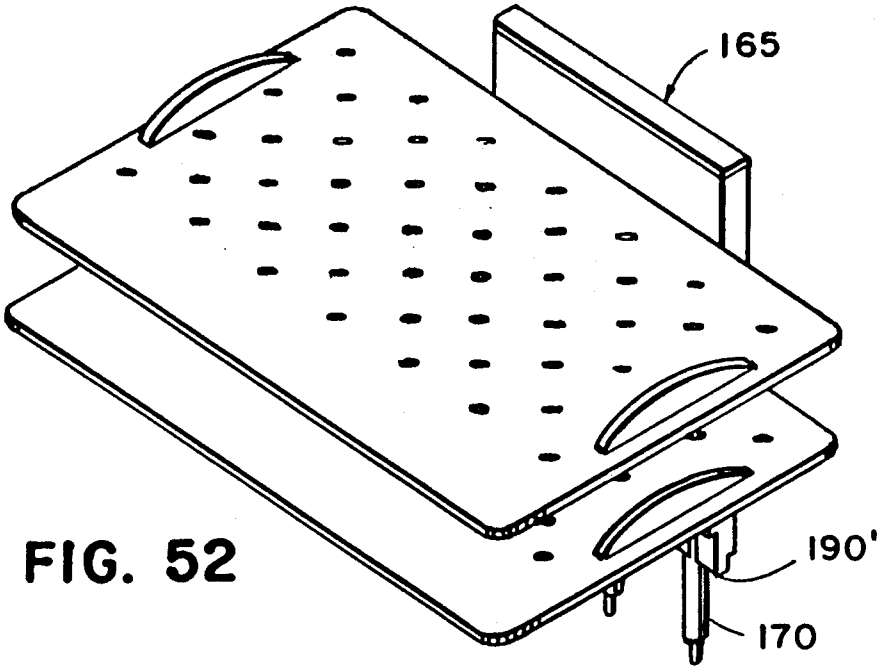
FIG. 52 is a perspective view of a two tray horizontal paper manager amenity unit.
Figure 53:
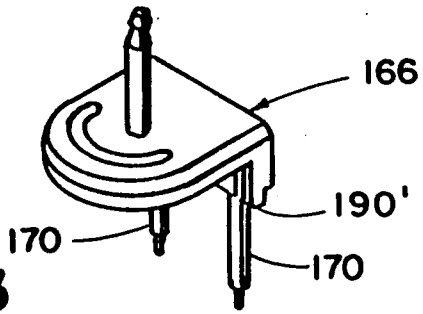
FIG. 53 is a perspective view of a task lamp base amenity unit.

At least some of the amenity units 13 (FIG. 34) are designed to be supported by amenity mounting rail 12, and serve to equip the workstation 11. In the illustrated examples, the upper portion of each amenity unit 13 has a device or configuration adapted to equip and support the workstation 11. For example, the amenity unit illustrated in FIGS. 44–46 comprises a secondary shelf 155. The amenity unit illustrated in FIG. 47–47B comprises a diagonal paper manager 160. The amenity unit illustrated in FIG. 48 comprises a telephone/utility tray 161. The amenity unit illustrated in FIG. 49 comprises an electric fan or air flow 162. The amenity unit illustrated in FIG. 50 comprises an angled display 163. The amenity unit illustrated in FIG. 51 comprises a three tray horizontal paper manager 164. The amenity unit illustrated in FIG. 52 comprises a two tray EDP/legal paper manager 165. The amenity unit illustrated in FIG. 53 comprises a task lamp base 166. The amenity unit illustrated in FIG. 54 comprises a binder bin 167, and the amenity unit illustrated in FIG. 55 comprises a task lamp 168.

Each of the illustrated amenity units 13 is capable of being supported on amenity mounting rail 12 by virtue of at least two depending pins or prongs 170. Some of the amenity units 11 are convertible, and may also be mounted freestanding on worksurface 5 in the manner described below. In the case of the illustrated non-convertible amenity units 155, 161, 162 and 167, the associated mounting prongs 170 are fixedly mounted in the amenity unit in the manner described in greater detail hereinafter. In the case of the illustrated convertible amenity units 160, 163, 164 and 165, the amenity units are adapted for freestanding support on the upper surface of the worksurface 5, or may be attached to mounting rail 12 by means such as a stanchion mounting conversion kit 171 (FIGS. 35–38).

Figure 40:
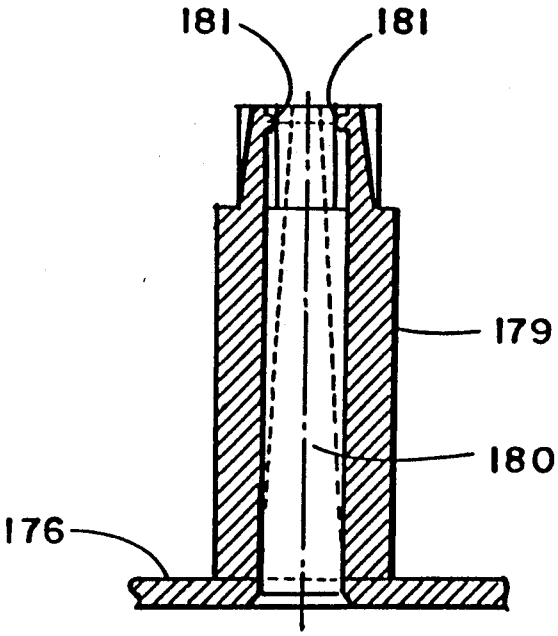
FIG. 40 is an enlarged, fragmentary vertical cross-sectional view of a snap-lock base portion of the diagonal paper manager amenity unit.
Figure 39:
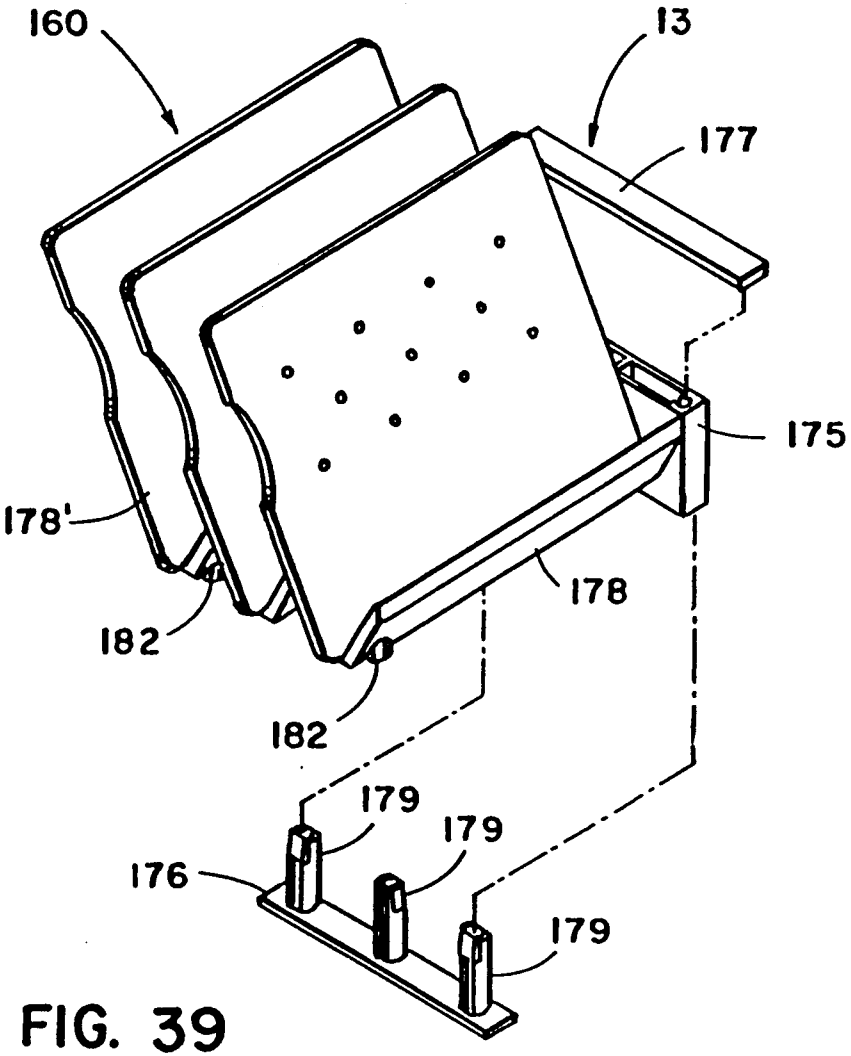
FIG. 39 is an exploded perspective view of a diagonal paper manager amenity unit.

With the exception of task lamp 168, each of the convertible amenity units, such as the diagonal paper manager 160 illustrated in FIGS. 39 and 40, has a similar construction, comprising a hollow body 175 with a base 176 mounted in the lower end thereof, and a cap 177 mounted on the upper end thereof. Amenity body 175 supports the particular amenity unit in a cantilevered fashion, which in example of FIG. 39, comprises a tray carrier 178, which is fixedly attached to the side of amenity body 175. A plurality of dividers 178' are detachably mounted in carrier 178 by a bottom latch arrangement (not shown), and support documents in an angular orientation. Amenity base 176 includes three upstanding sleeves 179, which form sockets 180 shaped to closely receive prongs 170 therein. Each sleeve 179 includes at least one snap-lock tab 181 which protrudes inwardly from a leaf spring arm at the upper end of the sleeve 179 to detachably lock prongs 170 in place, in the manner described in greater detail hereinafter. In the illustrated example, the center sleeve 179 has two, oppositely oriented tabs 181, while the remaining two sleeves 179 have only one tab 181. Amenity body 175, base 176 and cap 177 are fixedly interconnected by means such as an adhesive, or the like. The lower surface of amenity base 176 is adapted to abut the upper surface of the worksurface 5 when freestanding in a mar-free fashion. A pair of non-slip feet 182 are attached to and protrude downwardly from the bottom of tray assembly 178, and in conjunction with base 176, provide freestanding support for amenity unit 160 on worksurface 5.

Figures 42, 43:
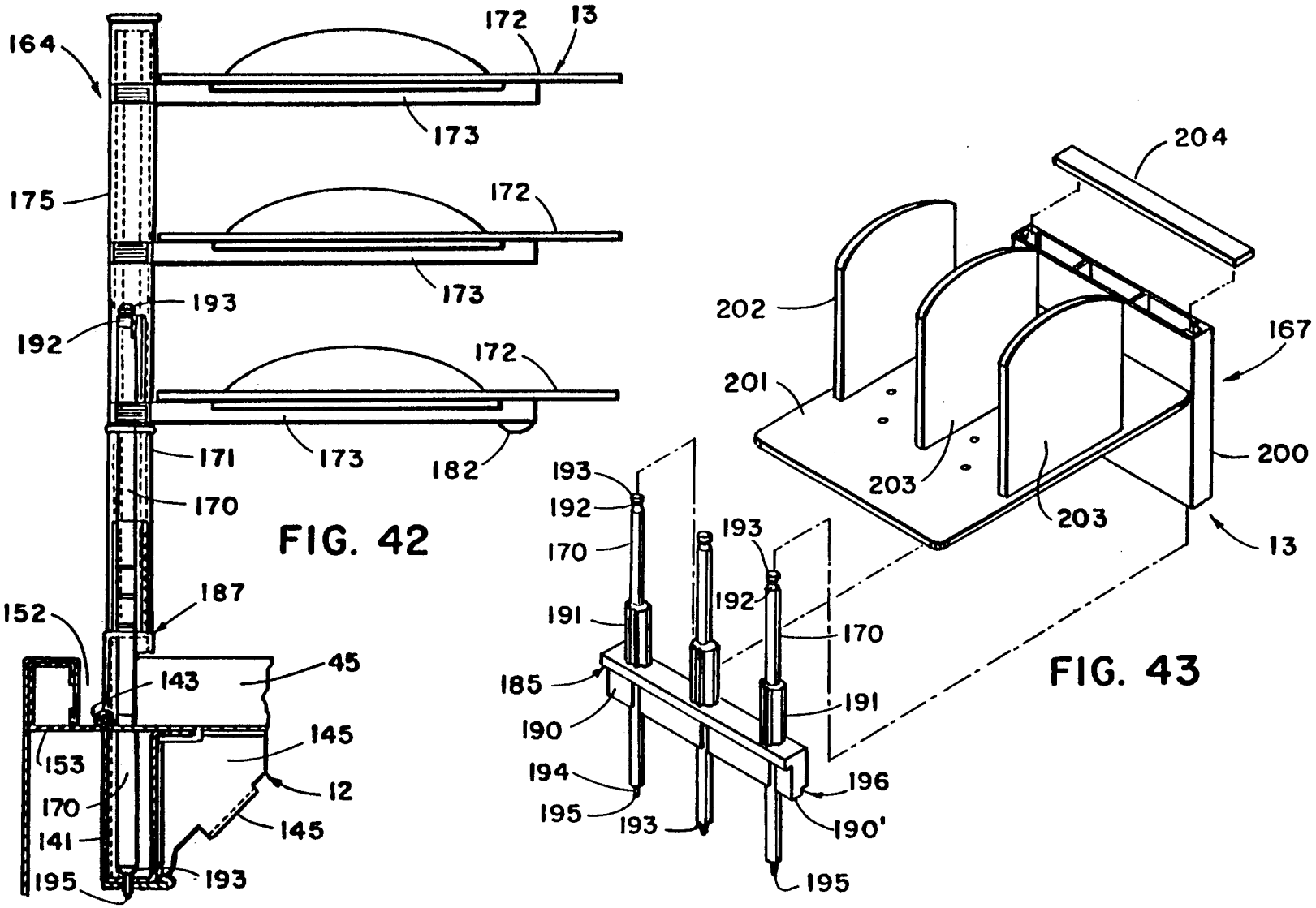
FIG. 42 is a fragmentary side elevational view of the straight modular furniture unit, showing attachment of a horizontal paper manager amenity unit in the amenity mounting rail.
FIG. 43 is an exploded perspective view of a binder bin amenity unit.

With reference to FIG. 42, the illustrated three tray horizontal paper manager 164 includes three trays 172, each of which is fixedly attached to amenity body 175 by a pair of pins 173 positioned at opposite sides of the tray 172. The illustrated pins 173 are solid, and have a generally square transverse cross-sectional shape, with a ribbed cylindrical inner end which is fixedly received in a mating aperture of amenity body 175. Trays 172 are attached to the upper surfaces of pins 173 by adhesive tape, or other such conventional fasteners.

Figure 41:
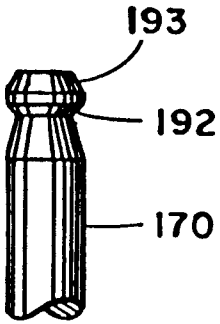
FIG. 41 is an enlarged fragmentary side elevational view of a prong portion of the stanchion.

Stanchion 171 (FIGS. 35–38) comprises a hollow rectangular body 184, having a prong assembly 185 mounted in the lower end thereof, and an open upper end. Prong assembly 185 includes a base 187, having an inverted L-shaped side elevational configuration, with an upper horizontal leg 188, and a lower vertical leg 190. Three rigid rods or prongs 170 are fixedly mounted in the upper leg 188 of stanchion base 187, and are oriented in a mutually parallel relationship. Each prong 170 includes a sleeve shaped spacer 191 located adjacent the upper surface of horizontal leg 188, and facilitates mounting prong assembly 185 within the interior of stanchion body 184. Prongs 170 protrude perpendicularly from both the top and bottom of stanchion body 184. The upper end of each prong 170 includes an annularly shaped groove 192 (FIG. 41) and a tapered or chamfered tip 193'. When prong 170 is inserted into the socket 180 of sleeve 179, tapered tip 193' diverges each leaf spring arm on which tab 181 is mounted, so as to form a snap-lock in groove 192, which has sufficient strength to prevent the amenity unit from being inadvertently removed from stanchion 171. More specifically, the snap-lock between prongs 170 and tabs 181 keeps stanchion 171 attached to the associated amenity unit 13 when the assembly is moved between various locations on mounting rail 12.

Figure 34:
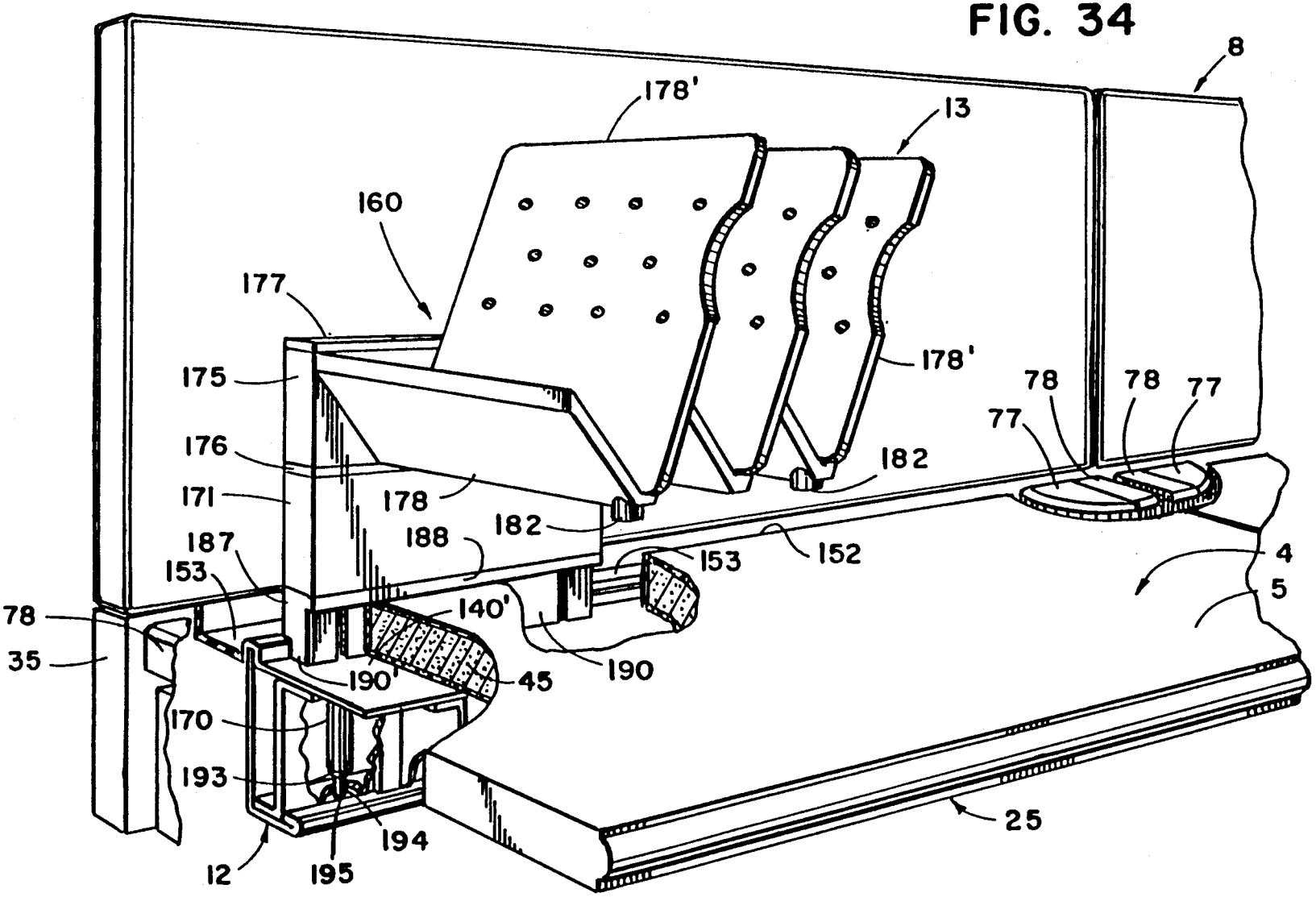
FIG. 34 is a perspective view of a straight modular furniture unit, with portions thereof broken away to reveal the attachment of a convertible amenity unit on the amenity mounting rail.

The lower ends of prongs 170 include a conically shaped collar 193 (FIGS. 35–38) which leads to a cylindrical point or nipple 194 having a reduced diameter with an inclined or tapered tip 195. The tapered configuration of tip 195 and cone shaped collar 193 facilitate inserting the prongs 170 of the amenity unit 13 into mounting rail 12. The obround shape of mounting apertures 148 also facilitates prong insertion. With reference to FIGS. 32–34, the cylindrically shaped shank portion of each prong 170 is shaped to be closely received within one of the upper obround mounting apertures 148 of mounting rail 12, while the narrower nipple 194 of prong 170 is shaped to be closely received within an associated one of the lower mounting apertures 149 of mounting rail 12. The collar 193 of prong 170 is disposed adjacent the upper surface of inner channel 142 when stanchion 171 and the associated amenities unit 13 are supported on mounting rail 12. The front channel 141 of mounting rail 12 closes the cavity into which prongs 170 are received, so as to positively prevent any wires that might be inserted through slot 152 from interfering with prong insertion.

Prongs 170 (FIGS. 35–38) extend through the upper horizontal leg 188 of stanchion base 187 on the rearward side of vertical lower leg 190. The forwardly facing free edge of base upper leg 188 is spaced slightly above the upper surface of worksurface 25, as illustrated in FIGS. 32 and 42. The lower rearward edge of stanchion base 187 includes a groove 196 having an inverted L-shaped side elevational configuration, which provides clearance for the rearward edge 143 of upper channel 140. The flat bottom 190' of base leg 190 defines a ledge or abutment surface adapted to engage the flat upper surface 140' of amenity rail 12, and thereby supports the associated amenity unit 13 in the manner to be described in greater detail below. Stanchion base 187 is fixedly mounted within stanchion body 184, by adhesive or the like, with the upper ends of prongs 170 projecting through the open upper end of stanchion body 184.

With reference to FIG. 43, the non-convertible amenity units 155, 161, 162, and 167 have a construction somewhat similar to the convertible amenity units 160, 163, 164 and 165, except that prongs 170 are fixedly mounted in the body of the amenity unit, such that the amenity unit cannot be made freestanding. In the binder bin amenity unit 167 illustrated in FIG. 43, a hollow rectangular body 200 supports a laterally extending fixed shelf 201 on which upstanding dividers 202 are mounted. A prong assembly 185, substantially identical to that used in stanchion 171, and described above, is fixedly mounted in the lower end of amenity body 200. A cap 204 is mounted on the upper end of amenity body 200.

In operation, any one of the amenity units 13 (FIG. 1) may be mounted anywhere along the rearward edge of the worksurface 5 by simply inserting prongs 170 into the apertures 148 and 149 of adjacent amenity mounting rail 12. As best illustrated in FIGS. 32, 34 and 42, when amenity unit 13 is set in mounting rail 12, the lower surface 190' of amenity unit 13 abuts the upper surface 140' of mounting rail 12, and thereby supports the weight of the amenity unit 13, as well as the weight of any articles or objects thereon. The engagement between the prongs 170 of amenity unit 13, and the apertures 148 and 149 of mounting rail 12 prevents rotation of the amenity unit 12 with respect to mounting rail 12, and securely, yet removably, retains the amenity unit 13 in its set, generally vertical orientation. Each amenity unit 13 may be readily removed from its set position by simply pulling the amenity unit 13 upwardly from the amenity mounting rail 12, and repositioning the same as desired.

Modular furniture arrangement 1 provides a unique means by which to partition off open office plans, independent of a partition panel system. Each furniture unit 4 comprises a freestanding assembly, wherein capped cutouts 6 in the worksurfaces 5 provide a very versatile means to mount overhead cabinets 7, privacy screens 8, and other similar accessories. The amenity mounting rail 12 extends continuously along at least one rearward edge of each of the worksurfaces 5, and is capable of removably supporting a plurality of different amenity units 13, so as to permit the user to personalize his or her own workstation 11. The L-shaped intermediate support 14 supports the associated worksurface 5 in a cantilevered fashion, so as to facilitate unfettered task chair movement along the forward edge of the worksurface.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property of privilege is claimed are defined as follows.

1. A modular furniture arrangement, comprising:

at least one worksurface panel;

at least one back panel;

at least two supports connected with said worksurface panel and said back panel to form a modular, freestanding furniture unit supported by said supports on a floor surface;

at least one overhead unit;

at least two rigid posts, having lower ends thereof adapted for connection with at least one of said supports and said back panel, and upper ends thereof adapted for connection with said overhead unit;

at least two mounting apertures disposed through said worksurface panel adjacent opposite rear corners thereof; each of said mounting apertures being shaped to receive an associated one of said posts therethrough;

at least two caps, each being shaped to close at least a portion of an associated one of said mounting apertures;

means for detachably supporting each of said caps on said worksurface panel over an associated one of said mounting apertures;

means for detachably and rigidly connecting the lower ends of said posts with said one of said supports and said back panel in a manner such that said posts extend upwardly from said furniture unit in a generally vertical orientation;

means for rigidly connecting the upper ends of said posts with said overhead unit, whereby to mount said overhead unit on said furniture unit, said caps are removed from said worksurface panel, said posts are inserted through said mounting apertures, the lower ends of said posts are securely fastened to said one of said supports and said back panel, and the upper ends of said posts are securely fastened to said overhead unit.

2. A modular furniture arrangement as set forth in claim 1, wherein:

said mounting apertures comprise arcuate cutouts at the opposite rear corners of said worksurface panel which extend between a rear edge and opposite side edges of said worksurface panel, and are bounded generally by an associated one of said supports and said back panel.

3. A modular furniture arrangement as set forth in claim 2, wherein:

said posts have an L-shaped plan configuration with opposite flanges positioned adjacent to an associated one of said supports and said back panel.

4. A modular furniture arrangement as set forth in claim 3, including:

at least one cover shaped to enclose an associated one of said posts and form a utility way therein between said worksurface panel and said overhead unit.

5. A modular furniture arrangement as set forth in claim 4, wherein:

said post upper ends are attached adjacent to a rear edge of said overhead unit to support the same in a cantilevered fashion over said worksurface panel.

6. A modular furniture arrangement as set forth in claim 5, including:

at least one privacy screen having first fastening means positioned adjacent opposite sides thereof for mounting said screen on said furniture unit; and second fastener means positioned on opposite sides of said furniture unit, and accessible through the mounting apertures in said worksurface panel; said second fastener means releasably engaging said first fastener means to detachably mount said privacy screen on said furniture unit in a generally vertical orientation adjacent the rear edge of said worksurface panel.

7. A modular furniture arrangement as set forth in claim 6, including:

at least two removable grommet covers, each being shaped to selectively cover an associated one of said second fastener means.

8. A modular furniture arrangement as set forth in claim 7, wherein:

said caps and said grommet covers are shaped to mate and collectively cover substantially all portions of the arcuate cutouts in said worksurface panel.

9. A modular furniture arrangement as set forth in claim 8, including:

a plurality of different amenity units, each having a lower end thereof with means for mounting the same on said furniture unit, and an upper end thereof with means for equipping said furniture unit;

a mounting rail connected with and supported by said furniture unit, and extending generally continuously along the rear edge of said worksurface panel; said mounting rail including a plurality of substantially identical apertures spaced generally regularly along the length of said mounting rail, and positioned fore-to-aft between said back panel and the rear edge of said worksurface panel; said apertures being shaped to closely receive therein the mounting means on the lower ends of any one of said amenity units to securely yet removably mount the same therein, whereby one or more of said amenity units can be arranged and detachably mounted in said mounting rail substantially anywhere along the rearward edge of said worksurface panel to personalize said furniture unit.

10. A modular furniture arrangement as set forth in claim 9, wherein:

said supports include at least one end panel shaped for connection with an end portion of said worksurface panel, and supporting the same.

11. A modular furniture arrangement as set forth in claim 10, wherein:

said supports include at least one intermediate support shaped for connection with an end portion of said worksurface panel, and supporting the same.

12. A modular furniture arrangement as set forth in claim 11, wherein:

said intermediate support has an inverted, generally L-shaped, side elevational configuration including a lower end adapted to abut the floor surface, and an upper arm connected with the end portion of said worksurface panel, whereby said intermediate support supports said worksurface panel on the floor surface in a cantilevered fashion, with the space disposed underneath said worksurface panel adjacent to said intermediate support being generally open and unobstructed to facilitate unfettered task chair movement along the forward edge of said worksurface panel.

13. A modular furniture arrangement as set forth in claim 12, wherein:

at least one of said amenity units includes a stanchion at the lower end thereof with said mounting means thereon; said stanchion including means for detachably connecting the same with the upper end of said one amenity unit; said upper end of said one amenity unit including a base shaped for abuttingly supporting said one amenity unit on said worksurface panel, whereby said one amenity unit can be supported either freestanding on said worksurface panel or connected with said stanchion and mounted on said mounting rail above said worksurface panel to permit personalization of said furniture unit.

14. A modular furniture arrangement as set forth in claim 1, wherein:

said posts have an L-shaped plan configuration with opposite flanges positioned adjacent to an associated one of said supports and said back panel.

15. A modular furniture arrangement as set forth in claim 14, including:

at least one cover shaped to enclose an associated one of said posts and form a utility way therein between said worksurface panel and said overhead unit.

16. A modular furniture arrangement as set forth in claim 1, wherein:

said post upper ends are attached adjacent to a rear edge of said overhead unit to support the same in a cantilevered fashion over said worksurface panel.

17. A modular furniture arrangement as set forth in claim 1, including:

at least one privacy screen having first fastening means positioned adjacent opposite sides thereof for mounting said screen on said furniture unit; and second fastener means positioned on opposite sides of said furniture unit, and accessible through the mounting apertures in said worksurface panel; said second fastener means releasably engaging said first fastener means to detachably mount said privacy screen on said furniture unit in a generally vertical orientation adjacent the rear edge of said worksurface panel.

18. A modular furniture arrangement as set forth in claim 17, including:

at least two removable grommet covers, each being shaped to cover an associated one of said second fastener means.

19. A modular furniture arrangement as set forth in claim 1, including:

a plurality of different amenity units, each having a lower end thereof with means for mounting the same on said furniture unit, and an upper end thereof with means for equipping said furniture unit;

a mounting rail connected with and supported by said furniture unit, and extending generally continuously along a rear edge of said worksurface panel; said mounting rail including a plurality of substantially identical apertures spaced generally regularly along the length of said mounting rail, and positioned fore-to-aft between said back panel and the rear edge of said worksurface panel; said apertures being shaped to closely receive therein the mounting means on the lower ends of any one of said amenity units to securely yet removably mount the same therein, whereby one or more of said amenity units can be arranged and detachably mounted in said mounting rail substantially anywhere along the rearward edge of said worksurface panel to personalize said furniture unit.

20. A modular furniture arrangement as set forth in claim 19, wherein:

at least one of said amenity units includes a stanchion at the lower end thereof with said mounting means thereon; said stanchion including means for detachably connecting the same with the upper end of said one amenity unit; said upper end of said one amenity unit including a base shape for abuttingly supporting said one amenity unit on said worksurface panel, whereby said one amenity unit can be supported either freestanding on said worksurface panel or connected with said stanchion and mounted on said mounting rail above said worksurface panel on said mounting rail to permit personalization of said furniture unit.

21. A modular furniture arrangement as set forth in claim 1, wherein:

at least one of said supports comprises an intermediate support having an inverted, generally L-shaped, side elevational configuration with a lower end adapted to abut the floor surface, and an upper arm connected with said worksurface panel adjacent a side edge thereof, whereby said intermediate support supports said worksurface panel on the floor surface in a cantilevered fashion, with the space disposed underneath said worksurface panel adjacent to said intermediate support being generally open and unobstructed to facilitate unfettered task chair movement along a forward edge of said worksurface panel.

22. A modular furniture arrangement, comprising:

at least one worksurface panel;

at least two supports connected with said worksurface panel to form a modular, freestanding furniture unit supported by said supports on a floor surface;

at least one overhead unit;

at least two rigid posts, having lower ends thereof adapted for connection with said supports, and upper ends thereof adapted for connection with said overhead unit;

least two mounting apertures disposed through said worksurface panel adjacent opposite rear corners thereof; each of said mounting apertures being shaped to receive an associated one of said posts therethrough;

at least two caps, each being shaped to close an associated one of said mounting apertures;

means for detachably supporting each of said caps on said worksurface panel over an associated one of said mounting apertures;

means for detachably and rigidly connecting the lower ends of said posts with said supports in a manner such that said posts extend upwardly from said furniture unit in a generally vertical orientation;

means for rigidly connecting the upper ends of said posts with said overhead unit, whereby to mount said overhead unit on said furniture unit, said caps are removed from said worksurface panel, said posts are inserted through said mounting apertures, the lower ends of said posts are securely fastened to said supports, and the upper ends of said posts are securely fastened to said overhead unit.

23. In a modular furniture arrangement of the type including worksurface panels, supports, back panels, and overhead units which are variously interconnected to create a desired furniture unit, the improvement of a transaction post construction therefor, comprising:

at least two rigid posts, each having a lower end thereof adapted for connection with at least one of an associated one of said supports and an associated one of said back panels, and an upper end thereof adapted for connection with an associated one of said overhead units;

at least one of said worksurface panels having at least two mounting apertures therethrough positioned adjacent opposite rear corners thereof, and each mounting aperture being shaped to receive an associated one of said posts therethrough;

at least two caps, each being shaped to close an associated one of said mounting apertures;

means for detachably supporting each of said caps on said one worksurface panel over an associated one of said mounting apertures;

means for detachably and rigidly connecting the lower ends of each of said posts with at least one of said one support and said one back panel in a manner such that said posts extend upwardly from said furniture unit in a generally vertical orientation;

means for rigidly connecting the upper ends of said posts with said associated overhead unit, whereby to mount said one overhead unit on said workstation, said caps are removed from said one worksurface panel, said posts are inserted through said mounting apertures, the lower end of each of each of said posts is securely fastened to at least one of said one support and said one back panel, and the upper ends of said posts are securely fastened to said overhead unit.

24. A modular furniture arrangement, comprising:

at least one worksurface panel;

at least two supports connected with said worksurface panel to form a modular, freestanding furniture unit supported by said supports on a floor surface;

at least one overhead unit;

at least two rigid posts, having lower ends thereof adapted for connection with said furniture unit, and upper ends thereof adapted for connection with said overhead unit; said posts each including first and second flanges fixedly interconnected along a common edge with free edges thereof spaced apart to define an open face therebetween, and a cover detachably connected with said flanges, and enclosing at least a portion of said open face to create a vertical channel in each of said posts through which utilities may be routed;

at least two utility apertures disposed through said worksurface panel adjacent opposite rear corners thereof;

at least two caps, each being shaped to close at least a major portion of an associated one of said utility apertures;

means for detachably supporting each of said caps on said worksurface panel over an associated one of said utility apertures;

means for rigidly connecting the upper ends of said posts with said overhead unit;

means for detachably and rigidly connecting the lower ends of said posts with said furniture unit when said caps are removed from said worksurface panel, such that said posts extend upwardly therefrom in a generally vertical orientation, and the vertical channel in each of said posts is generally aligned and communicates with an associated one of the utility apertures in said worksurface panel to facilitate routing utilities throughout said modular furniture arrangement.

25. A modular furniture arrangement as set forth in claim 24, wherein:

said posts have an L-shaped plan configuration with the free edges of said first and second flanges being turned inwardly to facilitate attachment of said cover thereto.

26. A modular furniture arrangement as set forth in claim 25, wherein:

said post upper ends are attached adjacent to a rear edge of said overhead unit to support the same in a cantilevered fashion over said worksurface panel.

27. A modular furniture arrangement as set forth in claim 26, including:

at least one back panel; and at least one brace connecting said back panel with one of said supports; said brace including first and second flanges fixedly interconnected along a common edge and between which first and second flanges is defined a vertical channel that is generally aligned and communicates with an associated one of said utility apertures to route utilities therethrough and into the vertical channel in an associated one of said posts.

* * * * *

UNITED STATES PATENT AND TRADEMARK OFFICE

CERTIFICATE OF CORRECTION

PATENT NO. : 5,094,174

DATED : March 10, 1992

INVENTOR(S) : Gary H. Grund et al

It is certified that error appears in the above-identified patent and that said Letters Patent is hereby corrected as shown below:

Column 6, line 16;
After "view" insert --of--.
Column 9, line 59;
After "thereof" insert --.--.
Column 11, line 4;
"tab 3" should be --tab 93--.
Column 12, line 6;
After "Fig." insert --2--.
Column 17, line 67;
"amenity unit 12" should be --amenity unit 13--.
Column 22, Claim 22, Line 5;
Before "least" insert --at--.
Column 22, Claim 23, Line 60;
Delete "of each" second occurrence.

Signed and Sealed this

Twelfth Day of October, 1993

Bruce Lehman

*Attest:*

BRUCE LEHMAN

*Attesting Officer*

*Commissioner of Patents and Trademarks*